US006500259B1

(12) United States Patent
Tamai et al.

(10) Patent No.: US 6,500,259 B1
(45) Date of Patent: Dec. 31, 2002

(54) COAT FILM TRANSFER TAPE CARTRIDGE AND COAT FILM TRANSFER TOOL

(75) Inventors: Shigeru Tamai, Ikeda (JP); Kouhei Koyama, Kyoto (JP); Masatoshi Shintani, Sanda (JP)

(73) Assignee: Seed Rubber Company Limited, Osaka (JP)

( * ) Notice: Subject to any disclaimer, the term of this patent is extended or adjusted under 35 U.S.C. 154(b) by 62 days.

(21) Appl. No.: 09/610,693

(22) Filed: Jul. 5, 2000

(30) Foreign Application Priority Data

Jul. 6, 1999 (JP) ..... 11-192358
Aug. 31, 1999 (JP) ..... 11-246146

(51) Int. Cl.[7] ..... B05C 17/10

(52) U.S. Cl. ..... 118/76; 118/106; 118/257; 156/577; 156/579; 400/695; 400/696; 400/700

(58) Field of Search ..... 118/76, 106, 257; 156/577, 579; 400/695, 696, 700

(56) References Cited

U.S. PATENT DOCUMENTS 5,759,270 A * 6/1998 Lee ..... 118/257
6,321,816 B1 * 11/2001 Koreska ..... 118/76

FOREIGN PATENT DOCUMENTS

WO WO99/01368 * 1/1999 ..... 118/76

* cited by examiner

*Primary Examiner*—Laura Edwards
(74) *Attorney, Agent, or Firm*—Rader, Fishman & Grauer, PLLC

(57) ABSTRACT

A refill type coat film transfer tool, specifically a tape cartridge for a coat film transfer type having a support main body of lightweight and simple structure, capable of replacing a coat film transfer tape easily, securely and promptly. The support main body has a support base plate for rotatably supporting the opposite side ends of rotary shafts of the pay-off reel and take-up reel supported detachably and rotatably on a rotary support shaft of the case of the coat film transfer tool, and this support base plate has a flat skeletal structure having an outer contour corresponding to the inner contour of the case. Therefore as compared with the conventional plastic container, the rate of use of materials in the entire device of the support main body itself is substantially curtailed.

42 Claims, 35 Drawing Sheets

FIG.35 (a) PRIOR ART
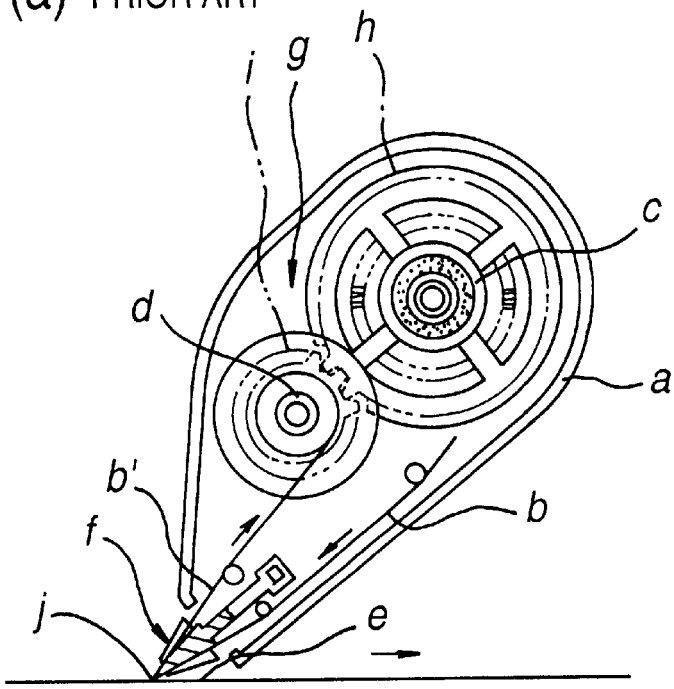
FIG.35 (b) PRIOR ART
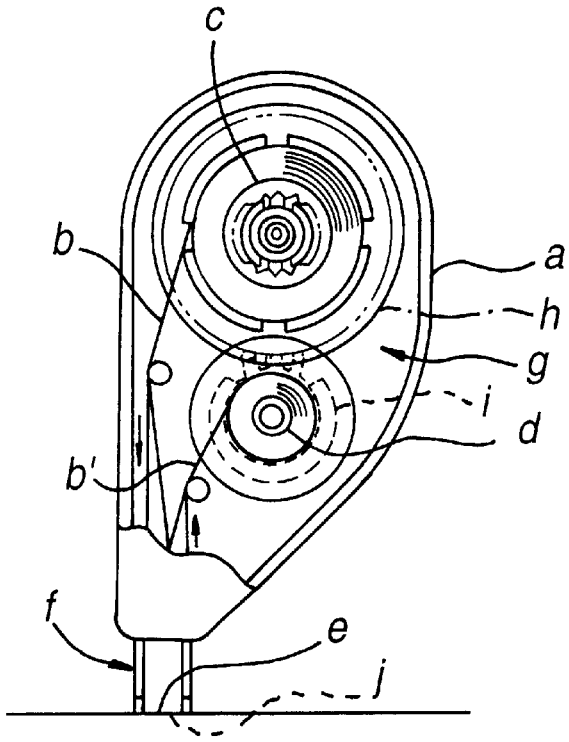

COAT FILM TRANSFER TAPE CARTRIDGE AND COAT FILM TRANSFER TOOL

BACKGROUND OF THE INVENTION

1. Field of the Invention

The present invention relates to a coat film transfer tape cartridge and a coat film transfer tool, and more particularly to a refill type coat film transfer tape loading technique for replacing a coat film transfer tape in a coat: film transfer tool for transferring correction paint layer, marker paint layer, adhesive layer or other coat film on a coat film transfer tape onto the sheet of paper or the like.

2. Description of the Related Art

The coat film transfer tool of this kind is disclosed, for example, in Japanese Patent Laid-open Publication No. 5-58097 and Japanese Utility Model Laid-open Publication No. 5-13800.

These coat film transfer tools are both used as an eraser for correcting wrong letters, and as shown in FIG. 35(*a*) and FIG. 35(*b*), a pay-off reel (c) on which a coat film transfer tape (b) is wound, and a take-up reel (d) for collecting the used coat film transfer tape (b') are rotatably provided in a case (a) which is held by one hand, and a coat film transfer head (f) for pressing the coat film transfer tape (b) onto the object of transfer (the correction area on the sheet of a paper) (e) is projecting from the leading end portion of the case (a) The both reels (c), (d) are automatically taken up as being linked mutually through an interlock unit (g) so as to cooperate. In the interlock unit (g), gears (h), (i) provided on the outer circumference of the both reels (c), (d) are engaged with each other.

The case (a) is a flat box having the contour shape and width dimension enough for incorporating the pay-off reel (c) and take-up reel (d), and the face and back of the flat shape, that is, the face and back to the sheet of paper in FIG. 35(*a*), (*b*) are the gripping sides when held by hand during use.

In the coat film transfer tool in FIG. 35(*a*), the leading end pressing portion (j) of the head (f) is designed to guide the coat film transfer tape (b) in a winding state of the pay-off reel (c) and take-up reel (d), and it is also-called vertical pulling structure suited to correction of a part of vertically written letters such as Japanese sentences. On the other hand, in the coat film transfer tool shown in FIG. 35 (*b*), the leading end pressing portion (j) of the head (f) is designed to guide the coat film transfer tape (b) almost oppositely to the gripping sides of the case (a), and it is a so-called lateral pulling structure suited to correction of a part of laterally written letters alphabetic sentences.

When correcting wrong letters by these coat film transfer tools, the gripping sides of the case (a) are held by fingers, the coat film transfer tape (b) is held tightly on the correction area (e) by means of the leading end pressing portion (j) of the head (f), and the case (a) is moved in a desired direction (arrow direction in FIG. 35 (*a*); vertical direction to sheet of paper in FIG. 35(*b*)). As a result, the correction paint layer of the coat film transfer tape (b) at the leading end pressing portion (j) of the head (f) is applied on the correction area (e) and the letter is erased, and the used coat film transfer tape (b') is automatically taken up and collected on the take-up reel (d).

Recently, on the other hand, an effective use of resources of the earth is particularly demanded, and from the viewpoint of saving of resources, in this kind of coat film transfer tool, it is desired to employ a so-called refill type structure for replacing only the consumable part of coat film transfer tape (b).

From such viewpoint, lately, various replaceable tape cartridges provided in the case (a) are proposed. The tape cartridge as the consumable part is generally classified into a structure comprising four parts, coat film transfer tape (b), pay-off reel (c), take-up reel (d), and head (f), and a structure comprising three parts, coat film transfer tape (b), pay-off reel (c), and take-up reel (d)

In the tape cartridge of either structure, however, all components are put in a plastic container, and they are replaced entirely together with the used tape cartridge, and in particular the plastic container is relatively large filling up the inner space of the case (a) of the coat film transfer tool, and the rate of occupation of the materials in the entire device is large, and the structure has been demanded to be reduced in weight and simplified.

The conventional tape cartridge further comprises a member (not shown) for stopping rotation of the pay-off reel (c) and take-up reel (d) until being loaded into the case (a), and this rotation stopping member is discarded as refuse after loading the tape cartridge, and this point must be also improved from the viewpoint of saving of resources.

SUMMARY OF THE INVENTION

It is a primary object of the invention to present a novel tape cartridge for a coat film transfer tool solving the problems of the prior art.

It is other object of the invention to present a tape cartridge having a support body of lightweight and simple structure, and capable of replacing the coat film transfer tape easily and promptly, by improving the structure of the refill type coat film transfer tool.

It is a further object of the invention to present a coat film transfer tool comprising such tape cartridge, and having a small, simple, and inexpensive structure that can be used like a writing tool flexibly depending on the manner of holding of a writing tool of an individual user.

A first tape cartridge of the invention is a tape cartridge for coat film transfer tool replaceably loaded in a case of a coat film transfer tool, the coat film transfer tool comprising a pay-off reel having the coat film transfer tool and a take-up reel for collecting the coat film transfer tape after use, both rotating in cooperation, and further a coat film transfer head for pressing the coat film transfer tape on a transfer area, in which at least the rotatable pay-off reel having the coat film transfer tape and the rotatable take-up reel for collecting the coat film transfer tape after use are provided on a support body, this support body has a support base plate for rotatably supporting the opposite side ends of rotary shafts of both reels supported detachably and rotatably on a rotary support shaft of the case, and this support base plate has a flat skeletal structure having an outer contour corresponding to the inner contour of the case.

Preferably, the skeletal structure of the support base plate is composed of an outer contour skeletal member forming the outer contour of the support base plate, a bearing skeletal member forming the bearing for rotating and supporting the rotary shaft of the reel, and a connection skeletal member for connecting the both skeletal members, which are connected in a flat skeletal structure. The connection skeletal member is formed as being extended in the radial direction from the bearing.

Further, on the outer peripheral edge of the support base plate, a protective wall is integrally formed upright for surrounding and protecting the both reels, and the support base plate and protective wall may be combined to form a cartridge case for surrounding and holding three sides of the both reels, and in this case the cartridge case composed of the support base plate and protective wall is preferred to be formed in one piece made of synthetic resin. In other preferred structure, on the outer circumference of the protective wall, there is an engaging part to be engaged with a positioning engaging part provided in the inner circumference of the case of the coat film transfer tool, and when the tape cartridge is put in the case of the coat film transfer tool, the both reels are rotatably supported on both sides by the rotary support shaft and support base plate of the case.

Also preferably, at least one of the two reels is provided with a clutch mechanism for synchronizing the pay-off speed and take-up speed of the coat film transfer tape in the both reels, and this clutch mechanism specifically comprises a cylindrical tape core on which the coat film transfer tape is wound, a rotary drive unit for rotating and driving the tape core, and an engaging support member to be engaged with the rotary drive unit in the axial direction, and the tape core is supported at both sides in the axial direction by the rotary drive unit and engaging support member, and the tape core and the rotary drive unit are frictionally engaged with each other in the rotating direction by power transmitting means making use of the frictional force by thrust load.

A second tape cartridge of the invention is a tape cartridge for coat film transfer tool replaceably loaded in a case of a coat film transfer tool, the coat film transfer tool comprising a pay-off reel having the coat film transfer tool and a take-up reel for collecting the coat film transfer tape after use, both rotating in cooperation, and further a coat film transfer head for pressing the coat film transfer tape on a transfer area, in which the rotatable pay-off reel having the coat film transfer tape and the rotatable take-up reel for collecting the coat film transfer tape after use are provided on a support body, this support body integrally comprises rotation stopping means for stopping and holding the rotation of the reels, and this rotating stopping means has a structure to be engaged with the reels to stop rotation of the reels in a state before the support body is installed in the case, and engaged with a rotation stop release part provided in the case and released from the reels in a state of the tape cartridge being installed in the case.

A coat film transfer tool of the invention is a refill type coat film transfer tool containing the tape cartridge detachably and capable of replacing the coat film transfer tape, comprising a hand-held case, and a rotary support shaft supporting a pay-off reel and a take-up reel of the tape cartridge detachably and rotatably provided therein, in which the both reels are rotated and held at both sides by the rotary support shaft and the support body of the tape cartridge. A coat film transfer head for pressing the coat film transfer tool on a transfer area is provided either at the leading end of the case or at the support body of the tape cartridge.

Preferably, the coat film transfer head provided either in the support body of the tape cartridge or in the case of the coat film transfer tool has a structure of which leading end pressing part is suited to lateral pulling use, or a structure rotating about the axial center of the head for keeping a position suited to the manner of holding a writing tool of the user.

In the tape cartridge of the invention, firstly, the support body has a support base plate for rotatably supporting the opposite side ends of rotary shafts of the pay-off reel and take-up reel supported detachably and rotatably on a rotary support shaft of the case of the coat film transfer tool, and this support base plate has a flat skeletal structure having an outer contour corresponding to the inner contour of the case, and therefore as compared with the conventional plastic container, the rate of use of materials in the entire device of the support body itself is substantially curtailed.

Secondly, the support body integrally comprises rotation stopping means for stopping and holding the rotation of the pay-off reel and/or take-up reel, and this rotating stopping means has a structure to be engaged with the reels to stop rotation of the reels in a state before the support body is installed in the case, that is, in an ordinary state, and engaged with a rotation stop release part provided in the case and released from the reels in a state of the tape cartridge being installed in the case, and therefore an independent rotation stopping member in the prior art that is discarded after use is not required at all.

Further, the support body has at least a rotatable pay-off reel on which a coat film transfer tape is wound, and a rotatable take-up reel for collecting the coat film transfer tape after use, so that it can be replaced instantly.

That is, the support body is designed to support rotatably the opposite side ends of rotary shafts of the both reels supported on the rotary support shaft of the case, and therefore the user has only to hold the support body and put the tape cartridge into the case while keeping the rotary shaft of the reels in engagement with the rotary support shaft of the case from the upper side, then the replacement procedure is over. In particular, in the structure in which the coat film transfer head is provided in the support body, setting of the coat film transfer tape on the coat film transfer head is completed already in the product stage, and the replacement is easier and faster.

In the coat film transfer head, its leading end pressing part is suited to lateral pulling use, or it is designed to rotate about the axial center of the head, so that the user can use with a sense of holding a writing tool.

In the latter structure, in particular, the coat film transfer head rotates about the axial center of the head in a specified range, and depending on the application or manner of holding by the user, the head position can be held in an appropriate state. It also includes a concept that the coat film transfer tool of the invention, if originally designed for use by a right-handed user in the head basic structure, can be held and used by a left-handed user naturally in an optimum head position.

These and other objects and features of the invention will be more clearly understood by reading the detailed description with the accompanying drawings and the novel facts indicated in the claims.

BRIEF DESCRIPTION OF THE DRAWINGS

FIG. 14(*b*) is a plan view of working state of the rotation stopping mechanism, showing the rotation stop released state of the pay-off reel.

FIG. 22(*b*) is a side view of the coat film transfer head.

FIG. 26(*b*) is a perspective view showing an engaging support member of the pay-off reel side position.

FIG. 30(*b*) is a perspective view showing an engaging support member of the pay-off reel side position.

FIG. 32(*b*) is a perspective view showing a pay-off rotary gear of the pay-off reel side position.

FIG. 35(*a*) is a partially cut-away front view of internal structure of a conventional eraser in vertical pulling use structure.

FIG. 35(*b*) is a partially cut-away front view of internal structure of a conventional eraser in lateral pulling use structure.

DETAILED DESCRIPTION OF THE PREFERRED EMBODIMENTS

Figure 1:
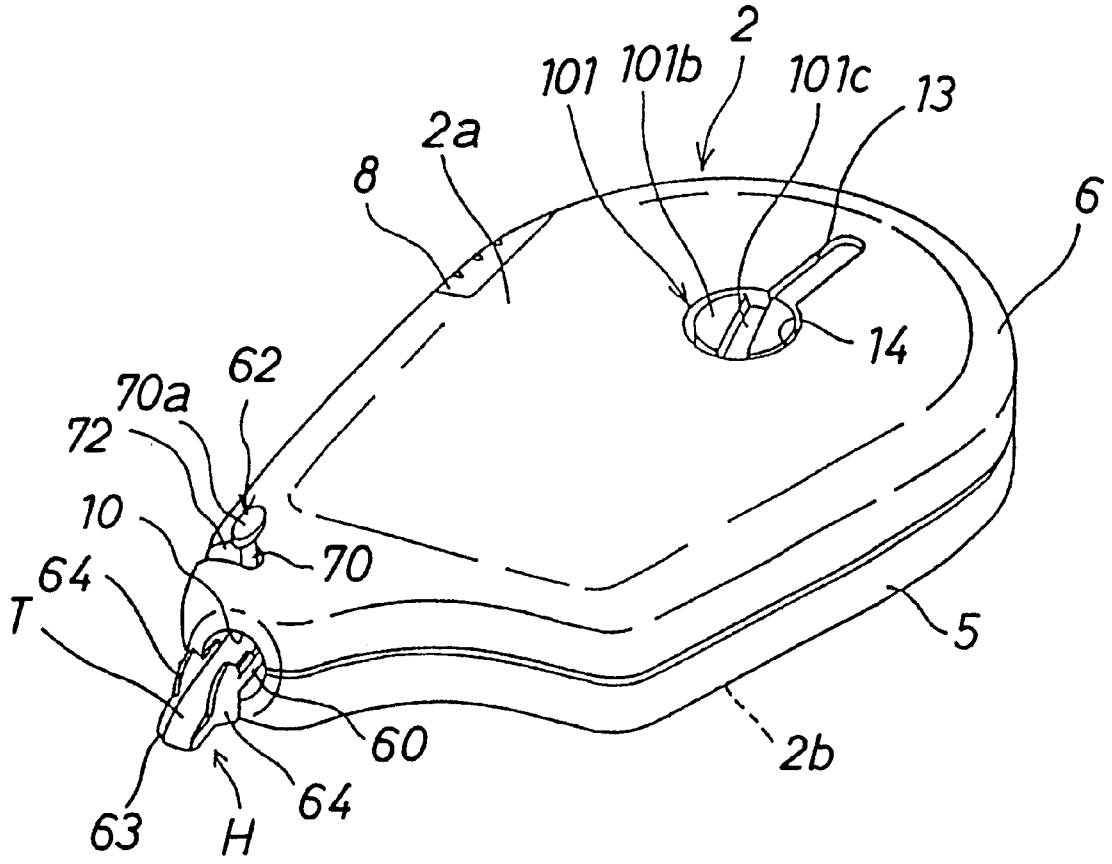
FIG. 1 is a perspective view showing an eraser in embodiment 1 of the invention.

Referring now to the drawings, preferred embodiments of the invention are described below.

FIG. 1 through FIG. 34 show the tape cartridge and coat film transfer tool of the invention, and same reference numerals given throughout the drawings indicate same structural members or elements.

Embodiment 1

A coat film transfer tool according to an embodiment of the invention is shown in FIG. 1 to FIG. 18. This coat film transfer tool 1 is specifically used as an eraser for correcting wrong letters, particularly relating to the cartridge type or refill type structure capable of replacing a coat film transfer tape T which is a consumable part.

Figure 3:
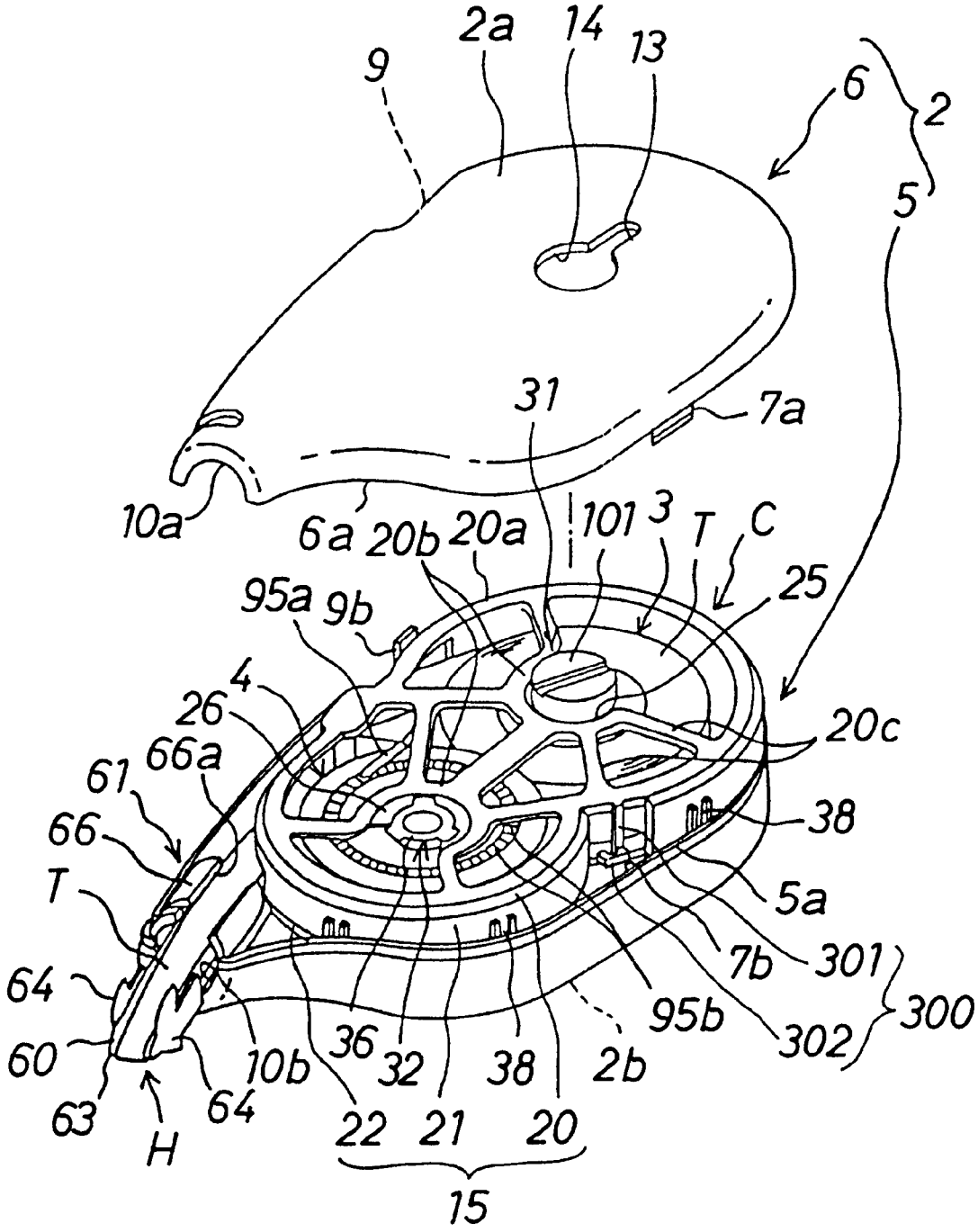
FIG. 3 is a perspective view of an open case state of the eraser.
Figure 4:
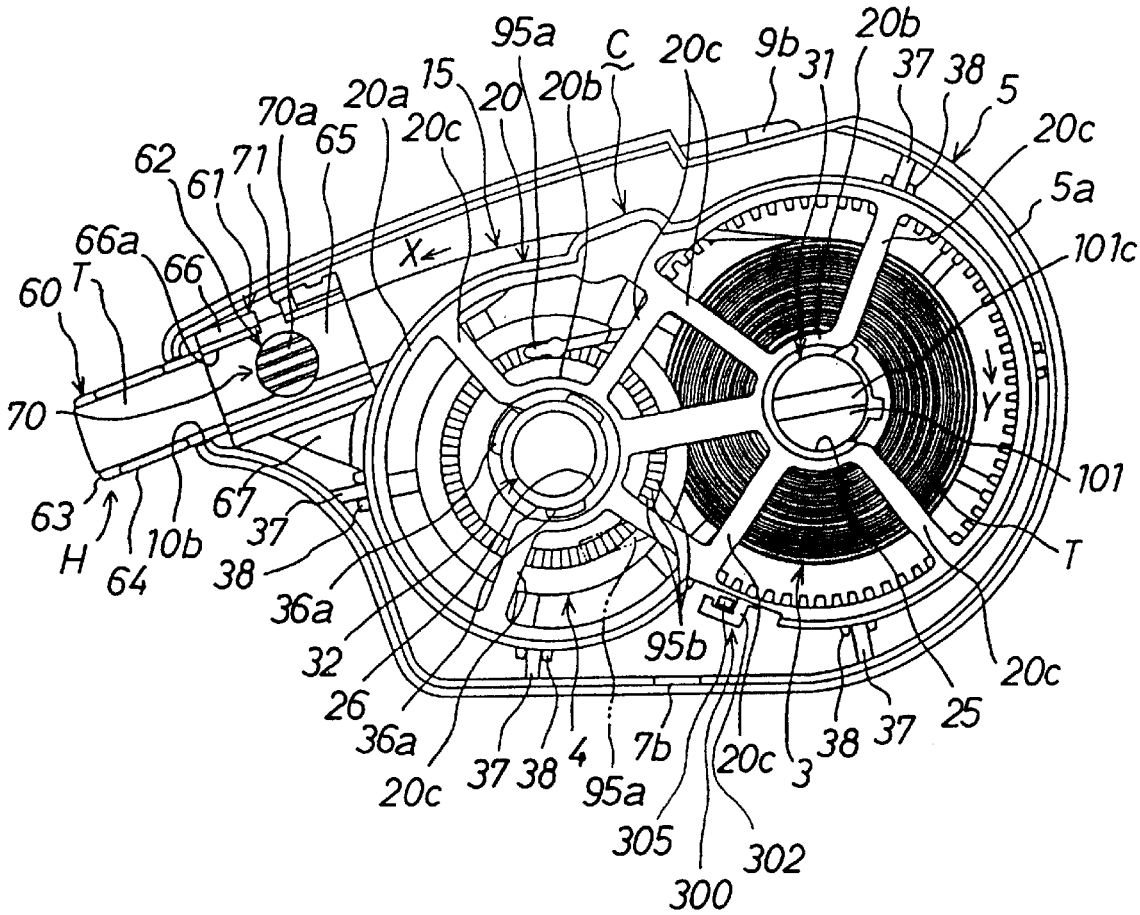
FIG. 4 is a front view showing the inside of the case main body of the eraser.

The coat film transfer tool 1 includes a case 2 having an appearance and shape as shown in FIG. 1, in which, as shown in FIG. 3 and FIG. 4, a tape cartridge C having a coat film transfer head H and a tape interlock unit (interlock mechanism) D are disposed, and moreover a pay-off reel 3 and a take-up reel 4 are supported on the tape cartridge C. Each component is described below.

I. Case 2

The case 2 is, as shown in the drawing, a flat box having a front contour shape and width dimension enough to incorporate the tape cartridge C and the tape interlock unit D, and, as mentioned below, its confronting pair of flat face and back surfaces 2*a*, 2*b* are standard gripping sides when held in hand during use.

The case 2 is a plastic structure molded integrally by injection molding or the like, consisting of a case main body 5 and a cap body 6 in a split structure, which can be separated from each other, and the tape cartridge C and tape interlock unit (interlock mechanism) D are mounted on the case main body 5.

Figure 5:
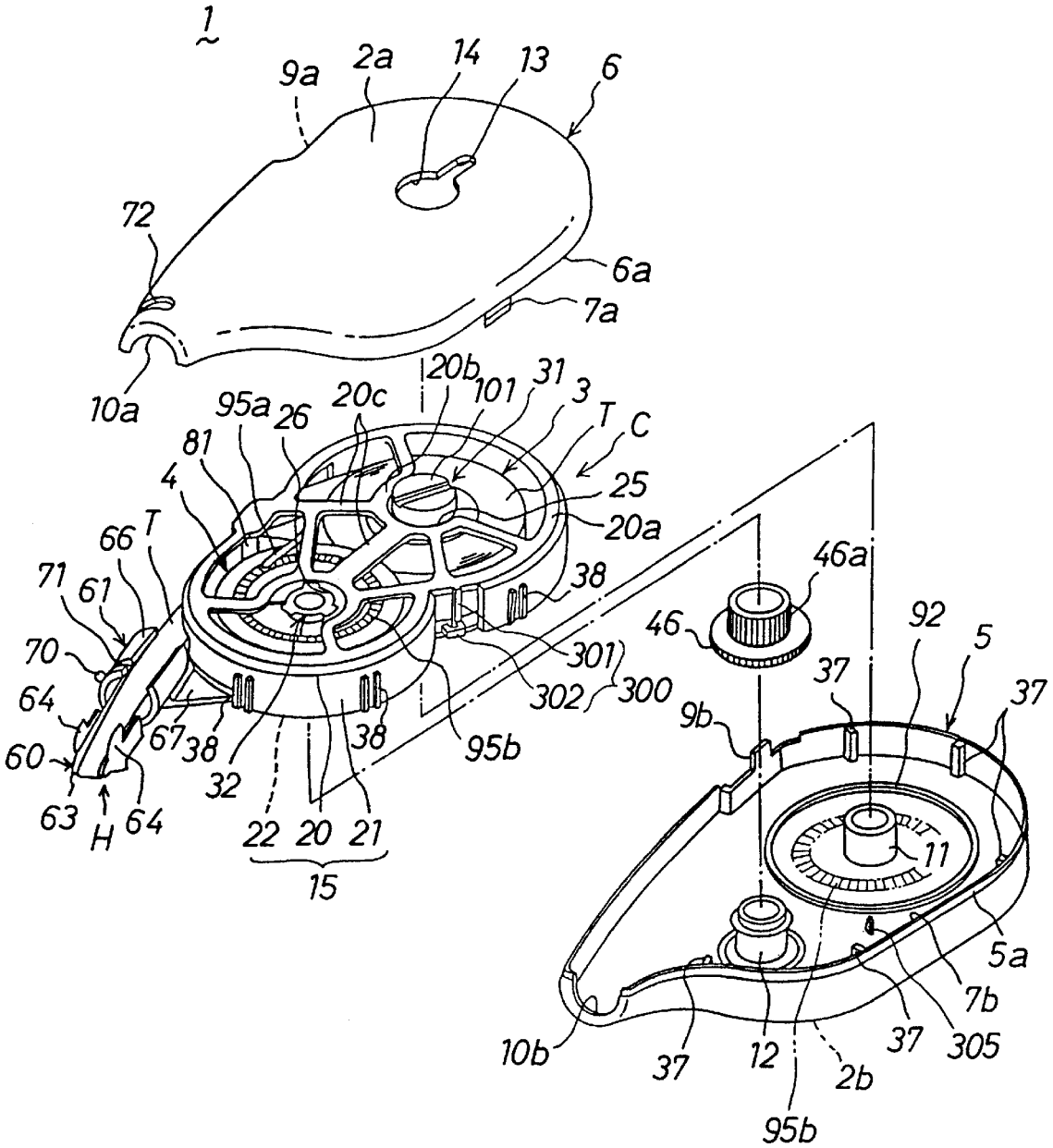
FIG. 5 is a perspective exploded view of the eraser.

The case main body 5 and cap body 6 are composed as shown in FIG. 3 and FIG. 5, in which an opening inner peripheral edge 6*a* of the cap body 6 is fitted to a fitting flange 5*a* provided on almost entire circumference of the opening inner peripheral edge of the case main body 5. At one side of the case main body 5 and opening of the cap body 6, engaging portions 7*a*, 7*b* engaged with each other separably and oscillatably are provided, and at the opposite side, engaging portions 9*a,* 9*b* tightened together by a tightening cap 8 are provided. The tightening cap 8 has the shape and dimension to be engaged with an operation groove 101*c* of a rewind button 101 described later, and also has a function as a plate operation member of the rewind button 101.

At the leading end portions of the case main body 5 and cap body 6, inserting grooves 10*a,* 10*b* for forming head insertion parts 10 for inserting the coat film transfer head H inside out are formed by notching, and at the inside of the case main body 5, moreover, hollow rotary support shafts 11, 12 are integrally provided for rotating and supporting the pay-off reel 3 and take-up reel 4 of the tape cartridge C.

By engaging the engaging portion 7*b* of the case main body 5 with the engaging portion 7*a* of the cap body 6, and assembling the cap body 6 into the case main body 5 by using these engaging portions 7*a,* 7*b* as the oscillation fulcrum, the cap body 6 is positioned on the case main body 5 and fixed, and the opening inner peripheral edge 6*a* of the cap body 6 is fitted into the fitting flange 5*a* of the case main body 5,, and the engaging portions 9*a,* 9*b* are engaged with each other. By sliding the tightening cap 8 to cover the engaging portions 9*a,* 9*b,* the both 9*a,* 9*b* are tightened to each other, and the case 2 is closed.

On the other hand, by the reverse manipulation, the case 2 is separated from the case main body 5 and cap body 6, and is opened. In this closing process of the case 2, the circular head insertion part 10 is opened and formed at the leading end portion, and through this head insertion part 10, the coat film transfer head H projects outside from the leading end portion of the case 2 and is positioned.

In the cap body 6, moreover, a remainder check window 13 for checking the remainder of the coat film transfer tape T and an opening 14 for a rewind button 101 mentioned below are continuously opened.

II. Tape cartridge C

The tape cartridge is a replaceable part as a consumable part, and its specific structure is shown in FIG. 2 to FIG. 12.

The tape cartridge C has a support main body 15, on which a pay-off reel 3 winding a coat film transfer tape T and a rotatable take-up reel 4 for collecting the used coat film transfer tape T' are rotatably mounted, and a coat film transfer head H for pressing the coat film transfer tape T onto the object of transfer is mounted rotatably about the axial center of the head. The tape cartridge C is mounted detachably on the case main body 5 as shown in FIG. 2 to FIG. 5.

The support main body 15 is, specifically, a synthetic resin structure formed as a cartridge case for accommodating the both reels 3, 4, and is preferably composed of recycle synthetic resin (regenerated material). This support main body 15 comprises a support base plate 20, a protective wall 21, and a protective plate 22. The support base plate 20 and protective wall 21 are formed in one body by injection molding or the like, and compose the principal parts of the support main body 15.

The support base plate 20 rotatably supports the both reels 3, 4, and its shape and dimension are set as thin and compact as possible within a range of assuring the holding function of the reels 3, 4.

Specifically, the support base plate 20 has a flat plate skeletal structure having an outer contour corresponding to the inner contour of the case 2.

The skeletal structure of the support base plate 20 comprises an outer contour skeletal member 20*a* for forming the outer contour of the support base plate 20, a pair of bearing skeletal members 20*b,* 20*b* for forming bearings 25, 26 for rotating and supporting the both reels 3, 4, and a plurality of connection skeletal members 20*c,* 20*c,* . . . for connecting the outer contour skeletal member 20*a* and bearing skeletal members 20*b,* 20*b,* which are connected together to form a flat plate skeleton.

The outer contour skeletal member 20*a* has an outer contour corresponding to the inner contour of the case 2 as mentioned above, and also composes a junction with a protective wall 21 mentioned later. The bearing skeletal members 20*b,* 20*b* form, as shown in the drawing, bearings 25, 26 in a flat arc shape opened in part. The connection skeletal members 20*c* are formed as being extended in the radial direction about the pair of bearings 25, 26.

By such skeletal layout structure, while maintaining the specified holding strength, a lightweight compact structure is realized by using materials as little as possible. In particular, by disposing the connection skeletal members 20*c,* 20*c,* . . . radially, a uniform strength is assured in the entire support base plate 20, and a lightweight compact structure is realized.

The both bearings 25, 26 designed to support rotatably the upper side ends of rotary shafts 31, 32 of the both reels 3 and 4, that is, the ends 31*a,* 32*a* at the opposite side of the side of the case main body 5 supported by the rotary support shafts 11, 12.

In a specific rotary support structure of the both reels 3, 4 in the bearings 25, 26, engaging portions 35, 36 are provided in the upper side ends 31*a,* 32*a* of the rotary shafts 31, 32 of the reels 3, 4, and these engaging portions 35, 36 are rotatably engaged with the inner support portions of the bearings 25, 26.

Figure 7:
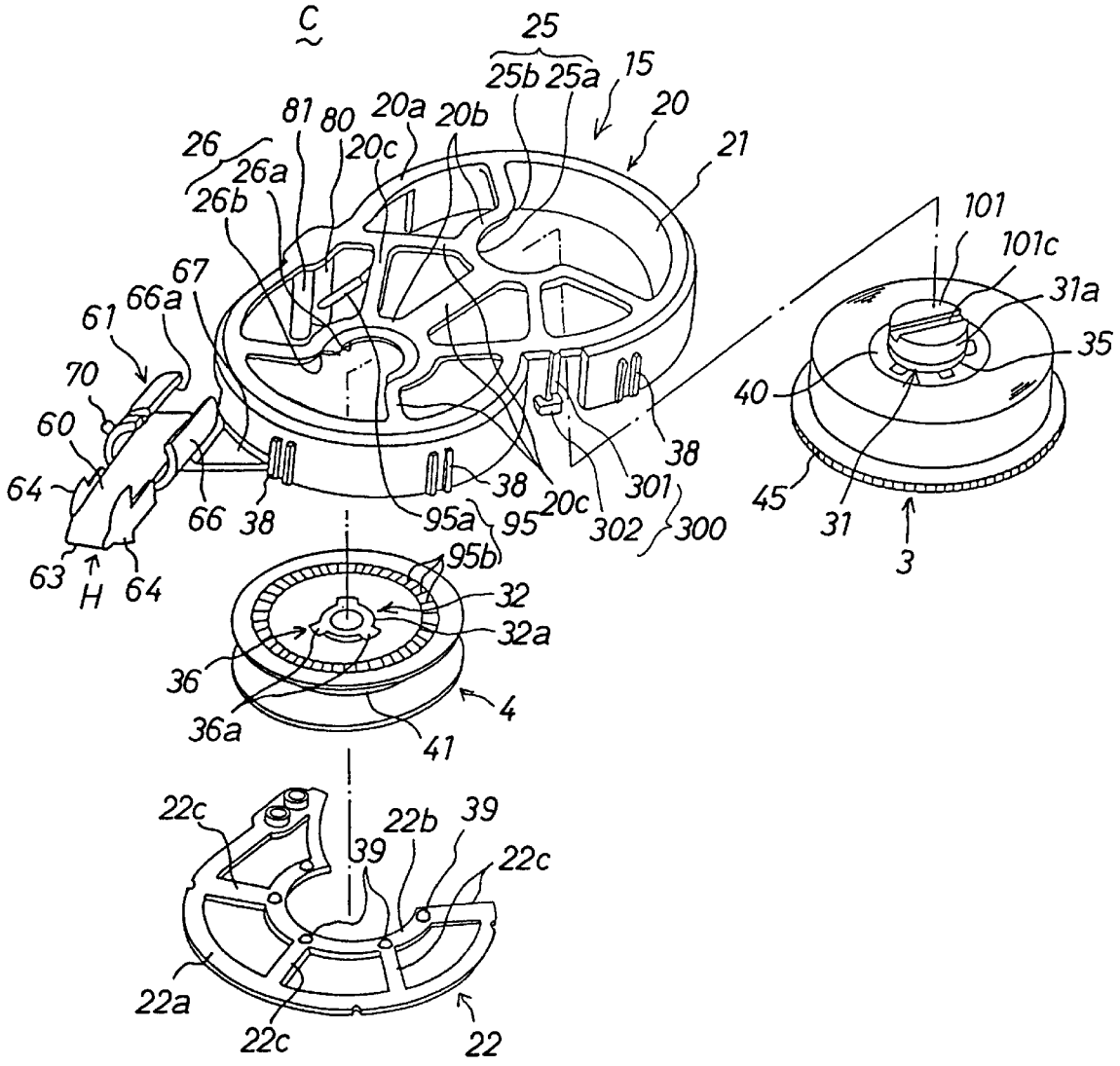
FIG. 7 is a perspective exploded view of the tape cartridge of the eraser.

In the illustrated embodiment, the bearings 25, 26 are in a form of bearings having outward openings opposite to each other as shown in FIG. 7. The flat shape of the bearings 25, 26 is designed in consideration of ease of assembling at the manufacturing site.

That is, the bearings 25, 26 are composed of circular parts 25*a,* 26*a* having an inner diameter corresponding to the outer diameter of the engaging portions 35, 36, and mounting insertion parts 25*b,* 26*b* spreading in a taper outward from the circular parts 25*a,* 26*a.*

The circular parts 25*a,* 26*a* of the bearings 25, 26 are disposed corresponding to the rotary support shafts 11, 12 of the case main body 5, respectively. Accordingly, in the configuration of the both reels 3, 4 on the support base plate 20, as shown in FIG. 4 and FIG. 5, the rotary shafts 31, 32 are set so as to be positioned coaxially to the rotary support shafts 11, 12, respectively.

On the other hand, the engaging portion 35 of the rotary shaft 31 of the pay-off reel 3 is an annular engaging groove formed in the entire circumference, and the engaging portion 36 of the rotary shaft 32 of the take-up reel 4 consists of a plurality of (three in this case) engaging pawls 36*a,* 36*a,* 36*a* formed at equal intervals in the circumferential direction.

In the both reels 3, 4, as the engaging portions 35, 36 of the rotary shafts 31, 32 are pressed and inserted by force from the mounting insertion parts 25*b,* 26*b* into the circular parts 25*a,* 26*a,* the boundary parts of the mounting insertion parts 25*b,* 26*b* and the circular parts 25*a,* 26*a* are expanded elastically, and are returned elastically, and the engaging portions 35, 36 are rotatably and slidably engaged and supported with the circular parts 25*a,* 26*a,* so that the both reels 3, 4 are positioned and supported at specified positions.

The protective wall 21 formed integrally with the support base plate 20 is provided in a standing form (or downward drooping form) from the outer peripheral edge of the support base plate 20, that is, the outer contour skeletal member 20*a*, and cooperates with the support base plate 20 to form the cartridge case for surrounding and accommodating the lower side of the both reels 3, 4, that is, three sides except the mounting side to the case main body 5.

This protective wall 21 is curved and formed so as to surround the outer circumference of the both reels 3, 4 along the outer contour shape of the support base plate 20, and surrounds and protects the outer circumference of the both reels 3, 4, and also reinforces the strength of the support base plate 20. Therefore, when assembling, handling and using the tape cartridge C, unexpected dislocation of the coat film transfer tape T from the pay-off reel 3 is prevented, and when handling the tape cartridge C, the coat film of the outermost surface of the coat film transfer tape T is covered and protected. Hence, the relative shape and dimensions of the protective wall 21 and the reels 3, 4 are set so as to achieve this object and to prevent effectively dislocation of the both reels 3, 4 from the bearings 25, 26.

The protective wall 21 also functions as the positioning means for determining the support main body 15 on the case main body 5. For this purpose, the outer circumference of the protective wall 21 has engaging portions 38, 38, . . . to be engaged with positioning engaging portions 37, 37, . . . provided in the inner circumference of the case 2. The engaging relation of these positioning engaging portion 37 and engaging portions 38 is determined in a structure detachable in the vertical direction and positioned in the lateral direction, that is, the horizontal direction.

In the state of the tape cartridge C being installed in the case main body 5, by positioning and engaging of the engaging portions 37, 38, 37, 38, . . . , the both reels 3, 4 are rotatably supported at both sides by the rotary support shafts 11, 12 of the main body case 5 and the support base plate 20 through the protective wall 21.

The protective plate 22 covers and protects the opposite side of the take-up reel 4 rotatably supported on the support base plate 20, and is provided at the open side edge of the protective wall 21. This protective plate 22 has a flat plate skeletal structure parallel to the support base plate 20, and its specific structure is designed to realize a lightweight compact structure by using materials as little as possible, while maintaining the specified strength, same as the support base plate 20.

That is, the protective plate 22 comprises, as shown in FIG. 7, an outer contour skeletal member 22*a* having a flat arc shape corresponding to the protective wall 21, an inner contour skeletal member 22*b* having the diameter corresponding to the lower side of the take-up reel 4, and radial connection skeletal members 22*c*, 22*c*, . . . for connecting the both 22*a*, 22*b*, which are connected in a skeletal structure.

At the inner side of the inner contour skeletal member 22*b* of the protective plate 22, that is, at the upper side, supports 39, 39, . . . for slidably and rotatably supporting the lower side of the take-up reel 4 are provided in annular form. By contrast, although not shown, at the lower side of the take-up reel 4, supports 39, 39, . . . are provided concentrically about the annular grooves to be engaged slidably and rotatably.

The pay-off reel 3 has a hollow cylindrical tape core 40 winding a new coat film transfer tape T, and also includes a clutch mechanism 50 interlocked with the tape core 40 and a pay-off rotary gear 45 of the tape interlock unit D. The specific mounting structure of the pay-off reel 3 is described later in relation to a clutch mechanism 50.

The take-up reel 4 is to take up and collect the used coat film transfer tape T', and the leading end portion of the coat film transfer tape T is connected to the outer circumference of the hollow cylindrical tape core 41.

The tape core 41 serves also as part of the rotary shaft 32 of the take-up reel 4, and its axial upper end is integrally formed coaxially with the upper end 32*a* mentioned above, and this upper end 32*a* is rotatably supported on the support base plate 20. On the other hand, in the center of the tape core 41 (32), there is a fitting hole 41*a* having a tooth profile engaging portion of serration or spline, and it is integrally engaged with a rotary shaft 46*a* of a take-up rotary gear 46 of the tape interlock unit D mentioned below, detachably and integrally in the rotating direction.

The coat film transfer tape T is, for example, a plastic tape of polyester or acetate, or film base material of paper tape or the like (about 25 to 38 $\mu$m in thickness), having one side coated with a parting layer of vinyl chloride-vinyl acetate copolymer resin, low molecular polyethylene or the like, with an overlaying white correction paint layer, and further with a pressure-adhesive polyurethane or other adhesive agent (pressure-sensitive adhesive) in a laminate structure (specific structure not shown). The correction paint layer is of so-called dry type allowing to write on immediately after transfer.

The coat film transfer head H is to press the coat film transfer tape T onto the correction area (transfer area) such as wrong letters on the sheet of paper, and has a function of guiding the coat film transfer tape T and a function of pressing. The coat film transfer head H is provided on the support main body 15, and its base end support unit is held on the support main body 15 rotatably about the head axial center. More specifically, the coat film transfer head H has a head main body 60, a head holder 61, and a rotating operation unit 62.

The head main body 60 is to press and transfer the coat film transfer tape T, and specifically it is a rectangular plate having a certain elasticity, and a supported portion 65 is integrally formed at the base end side position.

The head main body 60 in the illustrated embodiment is a thin plate slightly wider than the coat film transfer tape T, and has a taper section so as to be thinner gradually toward the leading end, and its flat both sides form the tape running sides, and the leading end 63 is the leading end pressing portion for pressing the coat film transfer tape T. At both side edges of the head main body 60, there are guide flanges 64, 64 for guiding the running motion of the coat film transfer tape T.

The head holder 61 is to support the head main body 60 rotatably about its axial center, and comprises the supported portion 65 and a bearing 66 provided in the support main body 15 at the device main body side.

Figure 8:
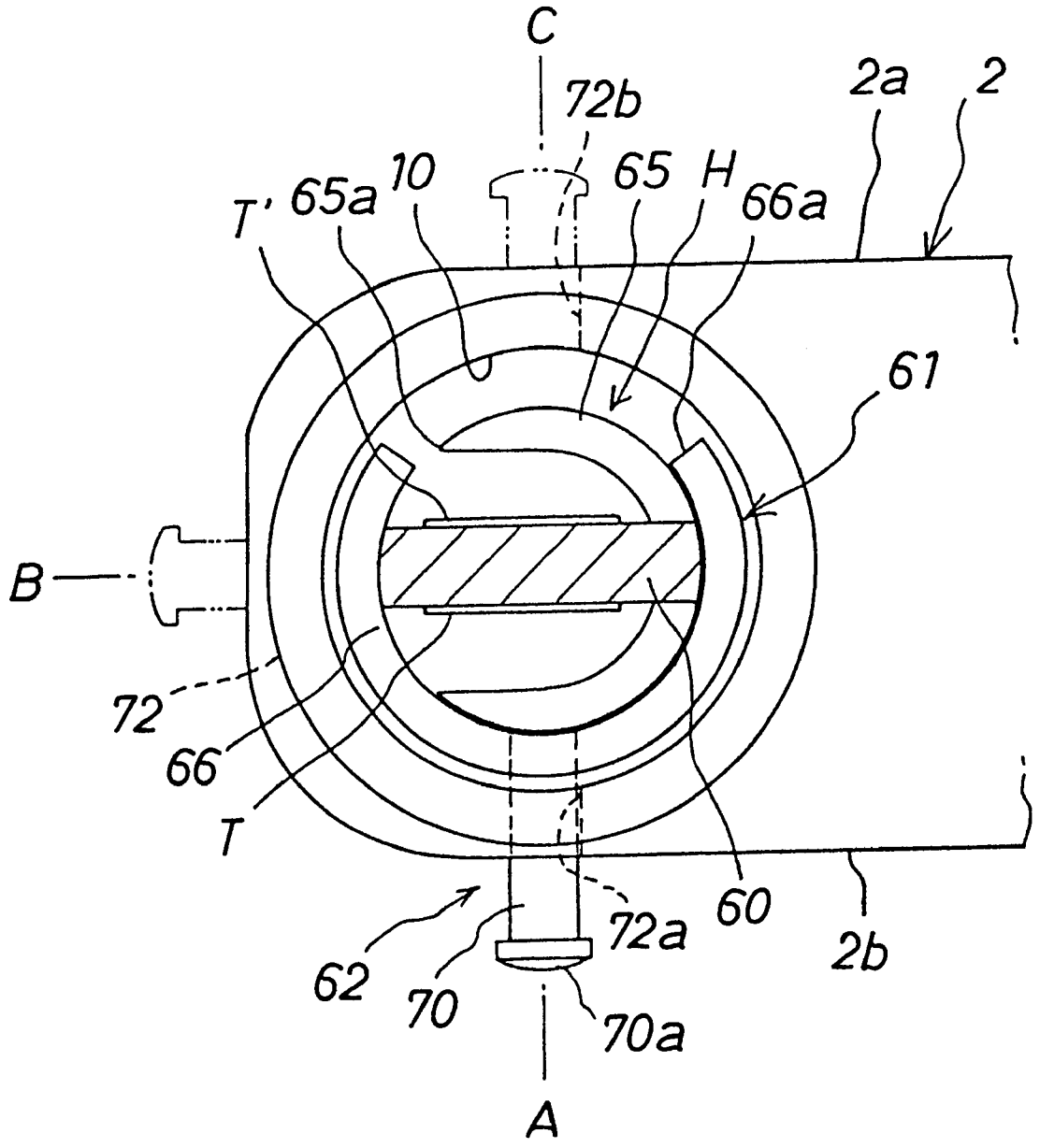
FIG. 8 is a magnified side view of a partial section of rotary structure of a coat film transfer head of the eraser.
Figure 9A:
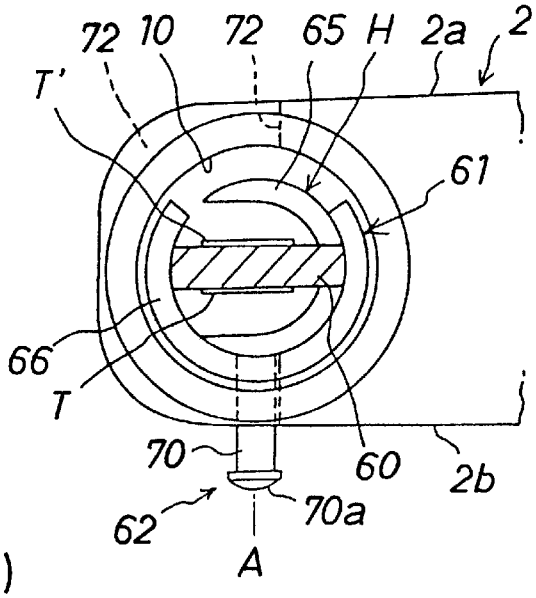
FIGS. 9(*a*)–9(*c*) are partial sectional side views for explaining the operation in rotating direction of the coat film transfer head of the eraser.
Figure 9B:
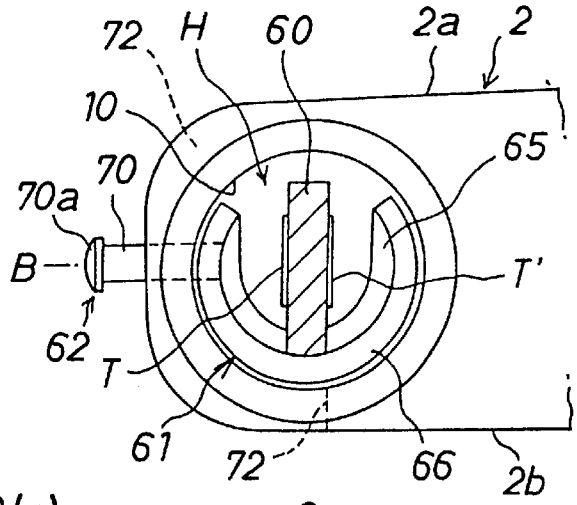
Figure 9C:
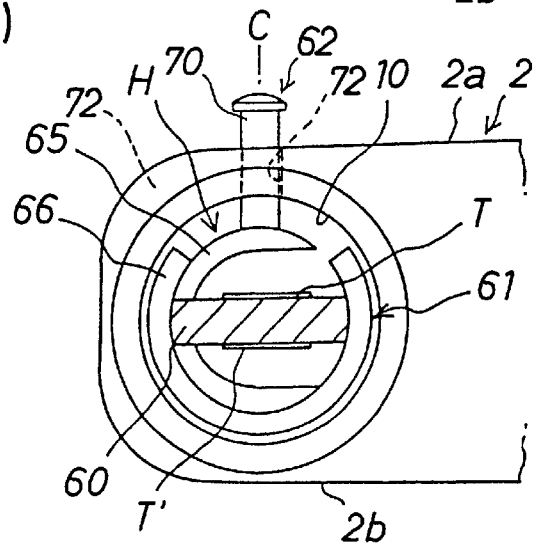

The supported portion 65 is a cylindrical piece provided concentrically and integrally with the head main body 60 as shown in FIG. 7 to FIG. 9, and more specifically a part thereof is formed in a section arc form having a setting opening 65*a* of the coat film transfer tape T to the head main body 60.

The bearing 66 is integrally provided at the leading end of the support main body 15 on the outer circumference of the protective wall 21 through the support unit 67. This bearing 66 is a tubular structure having an inner circumference corresponding to the outer circumference of the supported portion 65 as shown in FIG. 7 to FIG. 9, and, same as the supported portion 65, a part thereof is formed in a section arc form having a setting opening 66*a* of the coat film transfer tape T to the head main body 60. The supported portion 65 is slidably and rotatably supported on the bearing 66, and the head main body 60 is freely rotatably about the axial center, in a specified rotating angle range mentioned below.

The rotating operation unit 62 is to operate in order to determine the position of the head main body 60 in the rotating direction, and functions also as the head position indicating part for indicating the tape pressing and transferring position of the head main body 60.

The rotating operation unit 62 is a columnar bar, and has an operation lever 70 having an operation knob 70*a* at its leading end as a principal part. This operation lever 70 is integrally formed near the leading end of the supported portion 65, and is extended linearly outward in the radial direction from the axial center of the supported portion 65. Relating to this, at the axial direction corresponding position of the bearing 66, a slit-form insertion part 71 is provided, and similarly at the corresponding position of the case 2, a slit-form operation guide 72 is opened.

The operation lever 70 projects to outside of the case 2, through the insertion part 71 and operation guide 72. In this case, the insertion part 71 of the bearing 66 functions as locking piece for preventing the head main body 60 from slipping out in the axial direction.

The rotating direction disposing position of the operation lever 70 corresponding to the head main body 15 is set in relation to the tape pressing and transferring position of the head main body 15, and the inserting part 71 and operation guide 72 are extended in the peripheral direction so as to allow move of the operation lever 70 in the rotating direction of the head main body 15. In particular, the operation guide 72 of the case 2 defines the rotating direct ion operating range of the operation lever 70, and controls the tape pressing and transferring position of the head main body 60.

The relation between the operation lever 70 and the tape pressing and transferring position of the head main body 15 is explained below in relation to the operation guide 72 (see FIG. 8, FIG. 9, FIG. 15 to FIG. 18).

The composition of the operation guide 72 as the rotating direction operation range defining unit is determined as follows by reference to FIG. 8.

(*a*) When the operation lever 70 is in a state engaged with one end 72*a* of the operation guide 72, that is, at a vertical downward position (first defining position A shown in FIG. 9 (*a*)), the head main body 60 of the coat film transfer head H is at an angle position for guiding, with the leading end pressing part 63 setting the coat film transfer tape T almost opposite to the gripping sides 2*a*, 2*b* of the case 2, so that the face and back surfaces of the coat film transfer tape T may be almost in the same direction as (parallel to) the gripping sides 2*a*, 2*b*.

Figure 15:
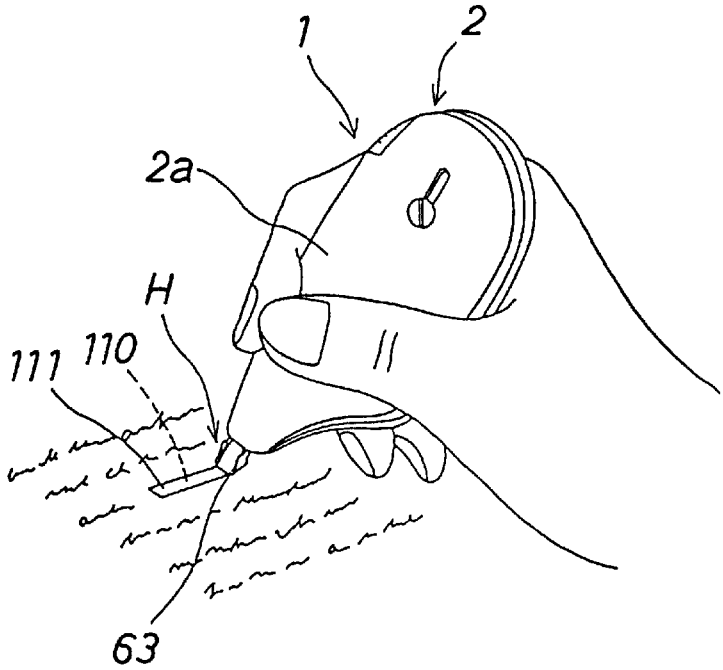
FIGS. 15(*a*)–15(*b*) are perspective views showing the lateral pulling use state by right hand of the eraser.
Figure 15B:
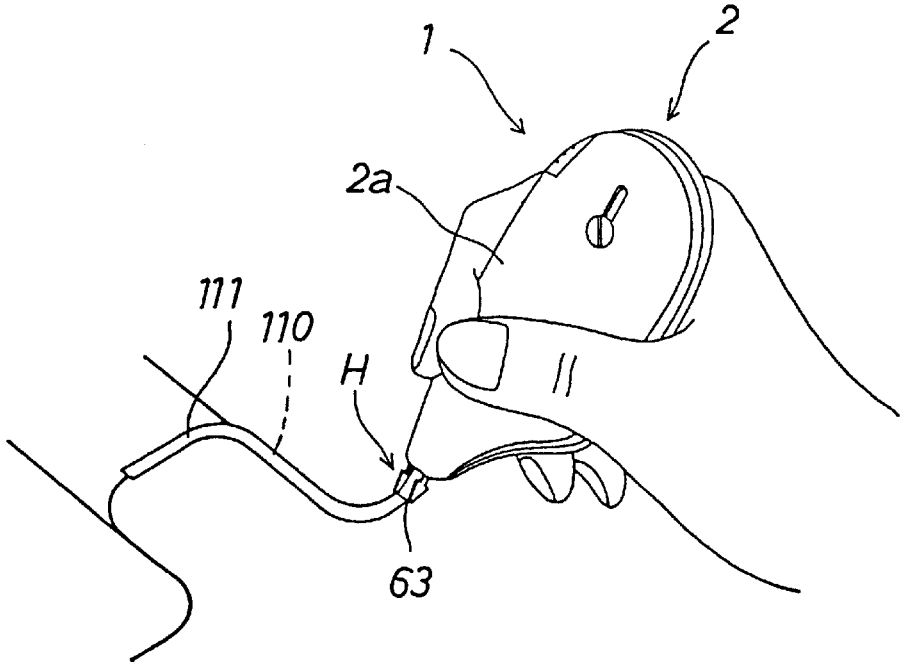

In this case, the new coat film transfer tape T forwarded from the pay-off reel 3 is at the lower side of the head main body 60, and it is in a state for lateral pulling use suited to a right-handed user for correcting a part of, for example, alphabetic writing (see FIG. 15).

(b) When the operation lever 70 is at an intermediate position between the both ends 72*a*, 72*b* of the operation guide 72, that is, at a horizontal position (second defining position B shown in FIG. 9(*b*) the head main body 60 of the coat film transfer head H is at an angle position for guiding, with the leading end pressing part 63 setting the coat film transfer tape T remaining at the winding position of the pay-off reel 3 and take-up reel 4, so that the face and back surfaces of the coat film transfer tape T may be almost in the vertical direction to (orthogonal to) the gripping sides 2*a*, 2*b*.

Figure 16:
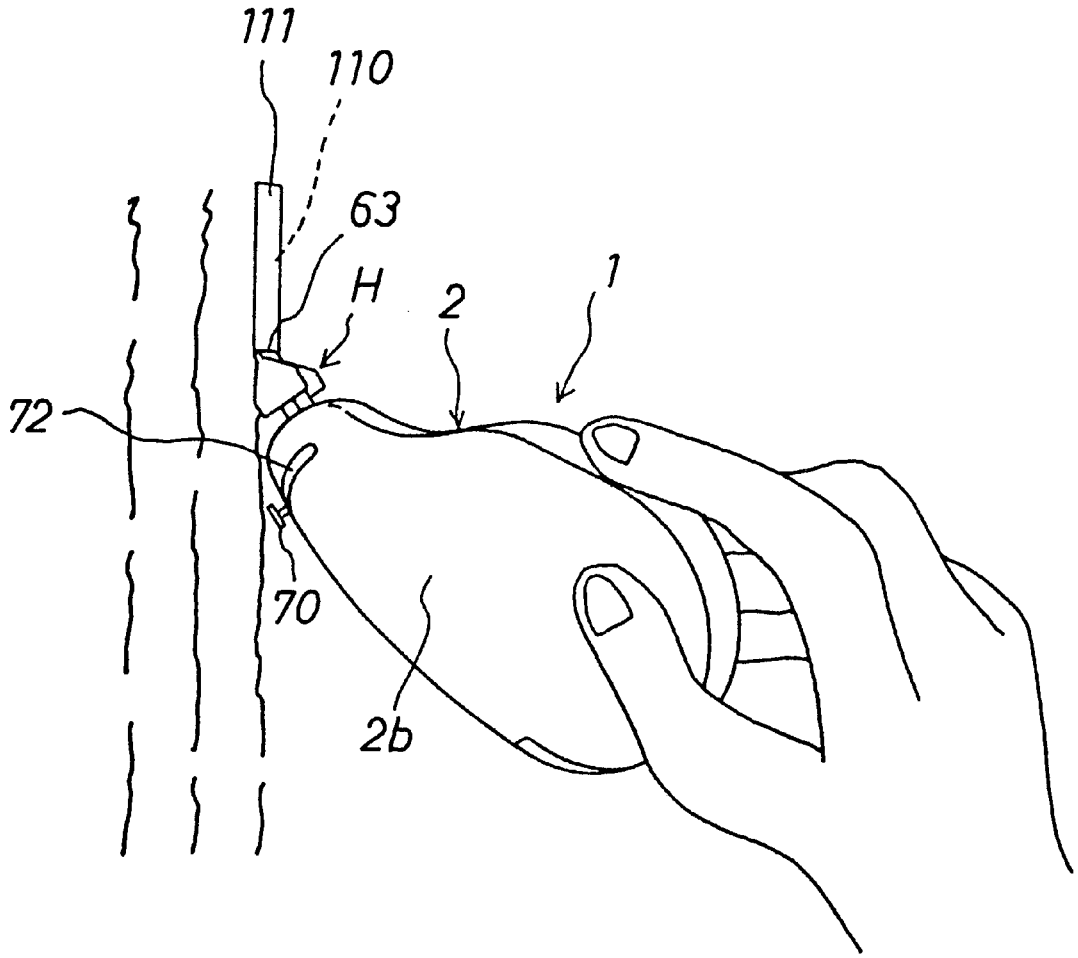
FIG. 16 is a perspective view showing the vertical pulling use state by right hand of the eraser.

In this case, the new coat film transfer tape T forwarded from the pay-off reel 3 is at left lower side of the head main body 60, and it is in a state for vertical pulling use suited for correcting a part of, for example, Japanese writing (see FIG. 16).

(c) When the operation lever 70 is engaged with other end 72*b* of the operation guide 72, that is, at a vertical upward position (third defining position C shown in FIG. 9(*c*)), the head main body 60 of the coat film transfer head H is at an angle position for guiding, with the leading end pressing part 63 setting the coat film transfer tape T almost oppositely to the gripping sides 2*a*, 2*b* of the case 2 in a state upside down of the case (a) above.

Figure 17A:
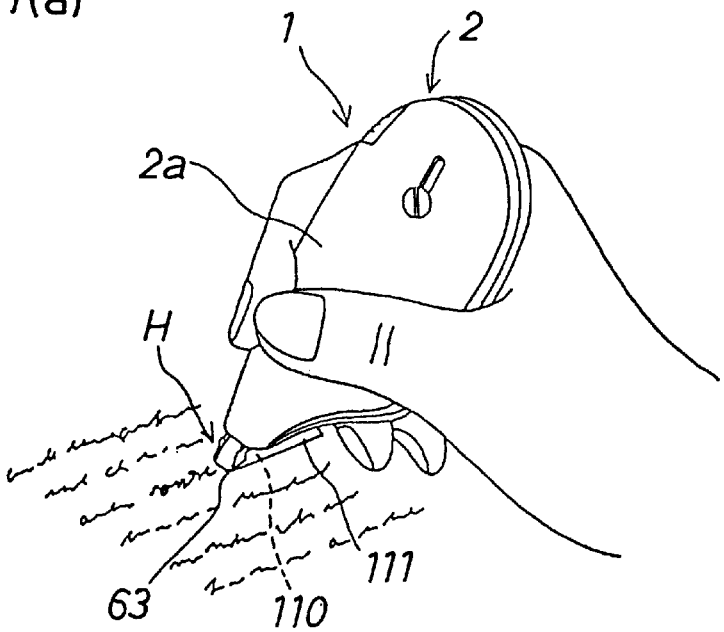
FIGS. 17(*a*)–17(*b*) are perspective views showing the lateral pushing use state by right hand of the eraser.
Figure 17B:
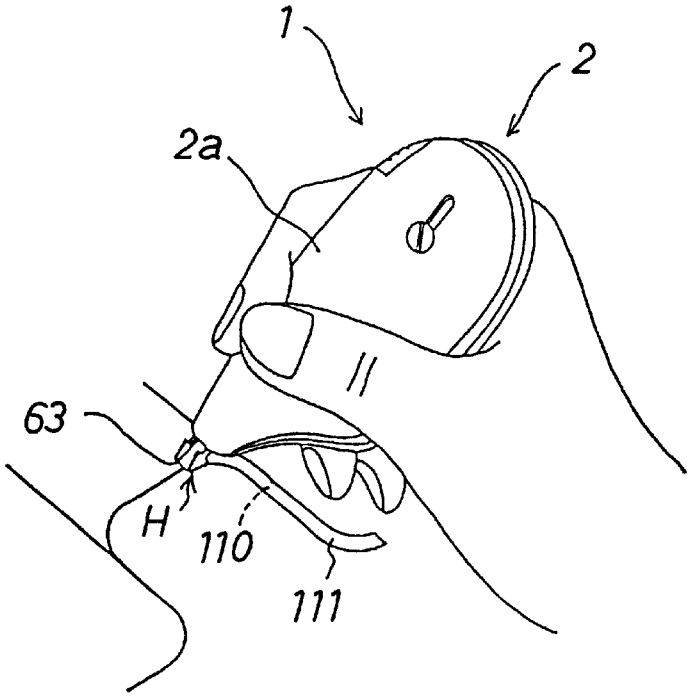
Figure 18A:
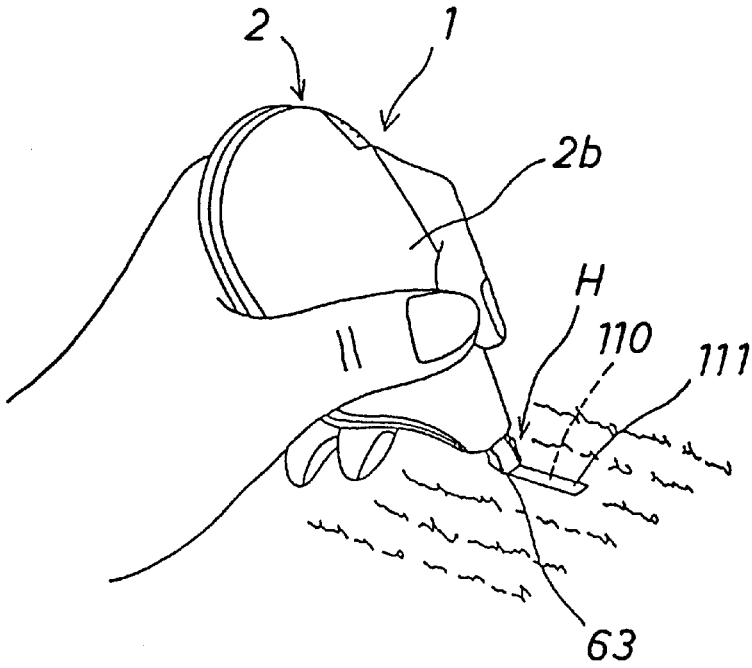
FIGS. 18(*a*)–18(*b*) are perspective views showing the lateral pulling use state by left hand of the eraser.
Figure 18B:
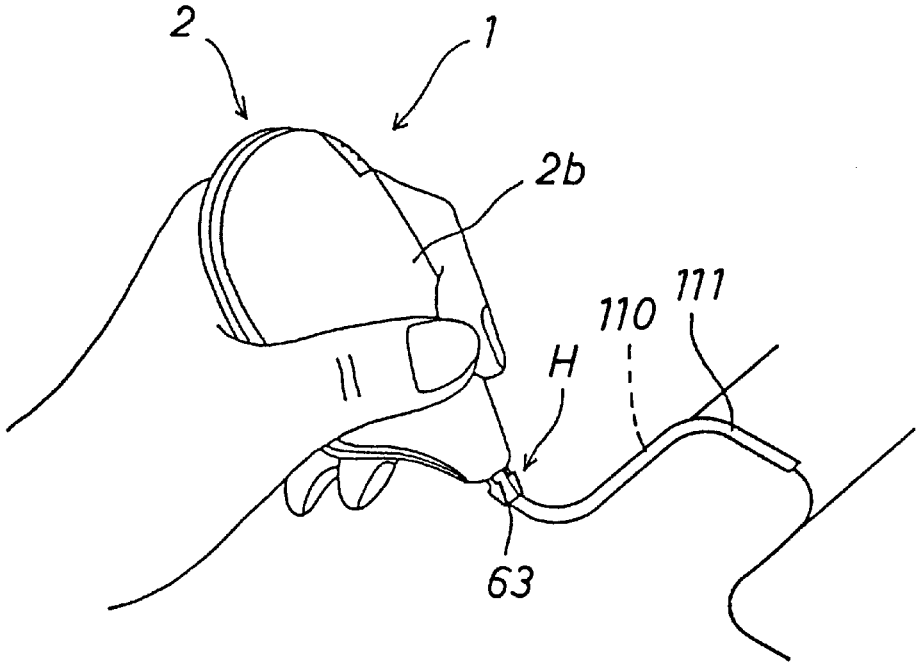

In this case, the new coat film transfer tape T forwarded from the pay-off reel 3 is at upper side of the head main body 60, and it is in a state for lateral pushing use suited to a right-handed user for correcting a part of, for example, alphabetic writing (see FIG. 17), or in a state for lateral pulling use suited to a left-handed user for correcting a part of, for example, alphabetic writing (see FIG. 18).

The rotating operation unit 62 is for positioning the head main body 60 in the rotating direction, and it also functions as head position indicating unit for indicating the tape pressing and transferring position of the head main body 60.

As clear from the description herein, the direction of the operation lever 70 indicates directly and visually the opposite direction of the new coat film transfer tape T (functioning as head position indicating unit) , and the user can check the tape pressing and transferring position of the head main body 60 by referring to the direction of this operation lever 70.

The rotating direction operating range of the operation guide 72 (almost 180° at maximum in the shown example) can be set in various values from a small angle range to a large angle range, in consideration of the relation with the operation lever 70 and tape pressing and transferring position of the head main body 60.

The coat film transfer tape T forwarded from the pay-off reel 3 is guided into the leading pressing portion 63 along the one-side tape running surface of the coat film transfer head H, and is inverted through the leading end pressing portion 63, and is further guided along the opposite-side tape running surface to be taken up on the take-up reel 4.

In this case, as mentioned above, the leading head pressing portion 63 of the coat film transfer head H cooperates with the tape running surface of the head side, and guides the coat film transfer tape T in various running positions as mentioned above.

Concerning the configuration of the coat film transfer head H and both reels 3, 4, a pair of guide pins 80, 81 are provided between the both reels 3, 4 of the support main body 15 and the coat film transfer head H, and these guide pins 80, 81 function as the tape position changing means for changing the running position of the coat film transfer tape T.

One guide pin 80 is for changing the position of the coat film transfer tape T forward from the pay-off reel 3 to guide into the coat film transfer head H, and is formed in an upright position integrally at a proper position of the support main body 15 between the pay-off reel 3 and the coat film transfer head H. Other guide pin 81 is for changing the position of the used coat film transfer tape T' from the coat film transfer head H to guide into the take-up reel 4, and it is formed in an upright position integrally at a proper position of the support main body 15 between the coat film transfer head H and take-up reel 4.

In such structure having the both guide pins 80, 81 provided in the support main body 15, setting of the tape T is all complete in the product stage, and a general use has only to replace the tape cartridge C.

Further, on the take-up side guide pin 81, a guide roller (not shown) is rotatably supported. In such structure, smooth and neat take-up guide of the coat film transfer tape T' is promoted, and if a part of the coat film is left over due to transfer failure on the coat film transfer tape T', the inconvenience of the coat film transfer tape T' being wound around the guide pin 81 can be securely prevented. A similar guide roller may be also provided in the pay-off side guide pin 80.

III. Tape interlock unit D

The tape interlock unit (interlock mechanism) D is for mutually interlocking the pay-off reel 3 and take-up reel 4, and more specifically it is composed of a pay-off rotary gear (interlock gear) 45 provided at the pay-off reel 3 side, and a take-up rotary gear (interlock gear) 46 provided at the take-up reel 4 side.

Figure 2:
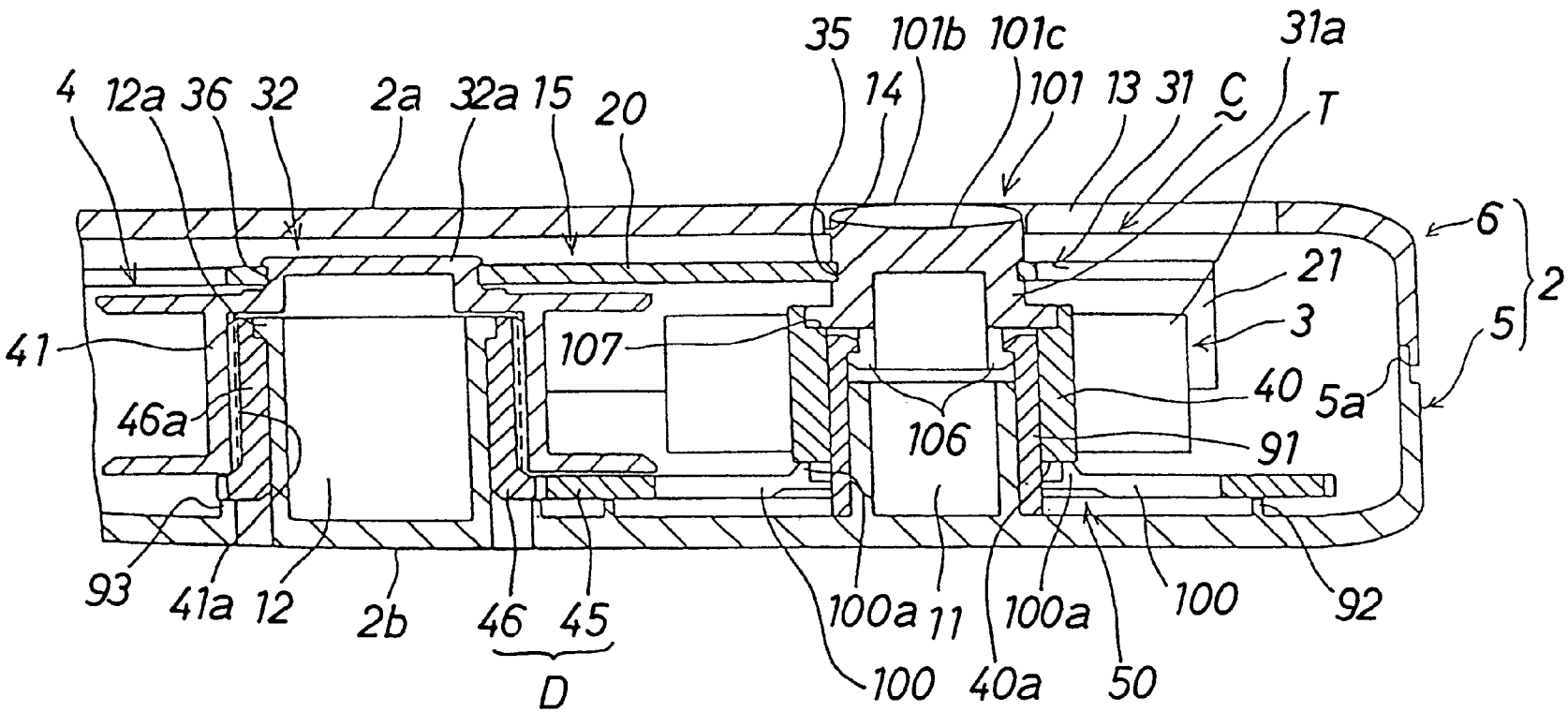
FIG. 2 is a side sectional view showing principal parts of the eraser.

The pay-off rotary gear 45 is formed integrally with a rotary drive unit 91 of the clutch mechanism 50 provided in the pay-off reel 3, and the rotary drive unit 91 functions also as rotary shaft of the pay-off rotary gear 45. The rotary drive unit 91 is a hollow cylinder, and is supported detachably and rotatably on the rotary support shaft 11 of the case main body 5. In this case, the axial lower end of the rotary drive unit 91 is slidably supported on the inner side of the case main body 5 as shown in FIG. 2. Reference numeral 92 is an annular rib provided at the inner side of the case main body 5, and this annular rib 92 is disposed corresponding to the outer circumference of the pay-off rotary gear 45 concentrically with the rotary support shaft 11, and slidably supports the lower side of the pay-off rotary gear 45, thereby preventing excessive distortion of the pay-off rotary gear 45.

On the outer circumference of the rotary shaft 91, the tape core 40 of the pay-off reel 3 is supported coaxially and rotatably, and the tape core 40 and pay-off rotary gear 45 are frictionally engaged with each other through engaging protrusions 100, 100, . . . which are frictional engaging members of the clutch mechanism 50 described later.

The take-up rotary gear 46 is rotatably supported on the rotary support shaft 12 of the case main body 5 for supporting the take-up reel 4, and is engaged with the pay-off rotary gear 45 formed in a unit together with the pay-off reel 3 in the support main body 15. At the leading end of the rotary support shaft 12, a locking piece 12*a* is provided for preventing the take-up rotary gear 46 from slipping out.

Further, at the inner side of the case main body 5, an annular rib 93 is provided concentrically to the rotary support shaft 12 and corresponding to the take-up rotary gear 46, and the take-up rotary gear 46 is slidably and rotatably supported on this annular rib 93.

The take-up rotary gear 46 is engaged with the pay-off rotary gear 45 at a specific gear ratio, so that the take-up rotary gear 46 rotates in cooperation with the pay-off rotary gear 45 always at a specific rotation ratio. The rotation ratio, that is, the gear ratio of the both gears 45, 46 is set properly so that the coat film transfer tape T may be paid off and taken up properly in consideration of the winding diameter of the coat film transfer tape T on the pay-off reel 3 and take-up reel 4 as mentioned later In this relation, as shown in FIG. 3 to FIG. 7, the support main body 15 and the tape core 41 of the take-up reel 4 are provided with reverse rotation preventive, mechanism (reverse rotation preventive means) 95 for preventing reverse rotation of the both reels 3, 4. The reverse rotation preventive mechanism 95 comprises, as shown in FIG. 4 and FIG. 7, a detent pawl 95*a* provided elastically deformably in the support base plate 20 of the support main body 15, and multiple reverse rotation preventive pawls 95*b*, 95*b*, . . . provided concentrically and annularly with the rotary shaft 32 on the outer side of the flange 41*b* of the tape core 41.

Accordingly, when the both reels 3, 4 are moved to rotate in the arrow direction, the detent pawl 95*a* rides over the reverse rotation preventive pawls 95*b*, 95*b*, . . . while deforming elastically, and allows the normal rotation. On the other hand, when the both reels 3, 4 are moved to rotate in the opposite direction of the arrow direction, the detent pawl 95*a* is engaged with any one of the reverse rotation preventive pawls 95*b*, 95*b*, . . . , and arrests the reverse rotation.

The reverse rotation preventive mechanism 95 also has, before the tape cartridge C is put in the case 2, a function of stopping and holding the rotation of the both reels 3, 4 in cooperation with rotation stopping mechanism (rotation stopping means) 300 described later.

Moreover, by forming one more detent pawl 95*a* at a confronting position to the detent pawl 95*a* on the diameter line of the annular circle of disposing the reverse rotation preventive pawls 95*b*, 95*b*, . . . (see virtual line in FIG. 4), reverse rotation preventive action of better balance is achieved.

Figure 6:
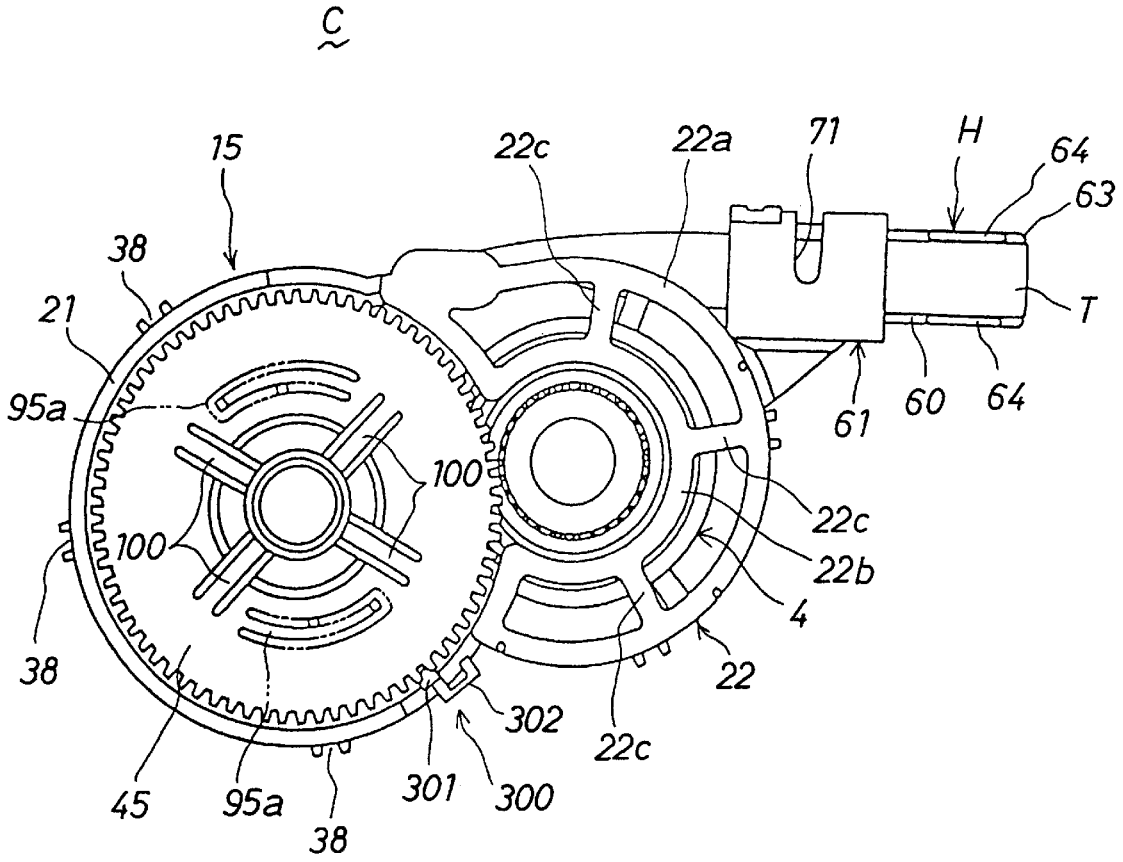
FIG. 6 is a back side view of a tape cartridge of the eraser.

The reverse rotation preventive mechanism 95 may be disposed, aside from the illustrated configuration, also between the case main body 5 and the take up rotary gear 45 or pay-off rotary gear 45, and for example, when the reverse rotation preventive mechanism 95 is disposed between the case main body 5 and pay-off rotary gear 45, preferably indicated by double dot chain line in FIG. 5 and FIG. 6, it is composed of a pair of detent pawls 95*a*, 95*b* integrally formed in the pay-off rotary gear 45 so as to be deformable elastically, and multiple reverse rotation preventive p awls 95*b*, 95*b*, ... disposed at the inner side of the case main body 5, between the rotary support shaft 11 and annular rib 92 in a concentric annular form therewith.

IV. Clutch mechanism 50

Figure 10:
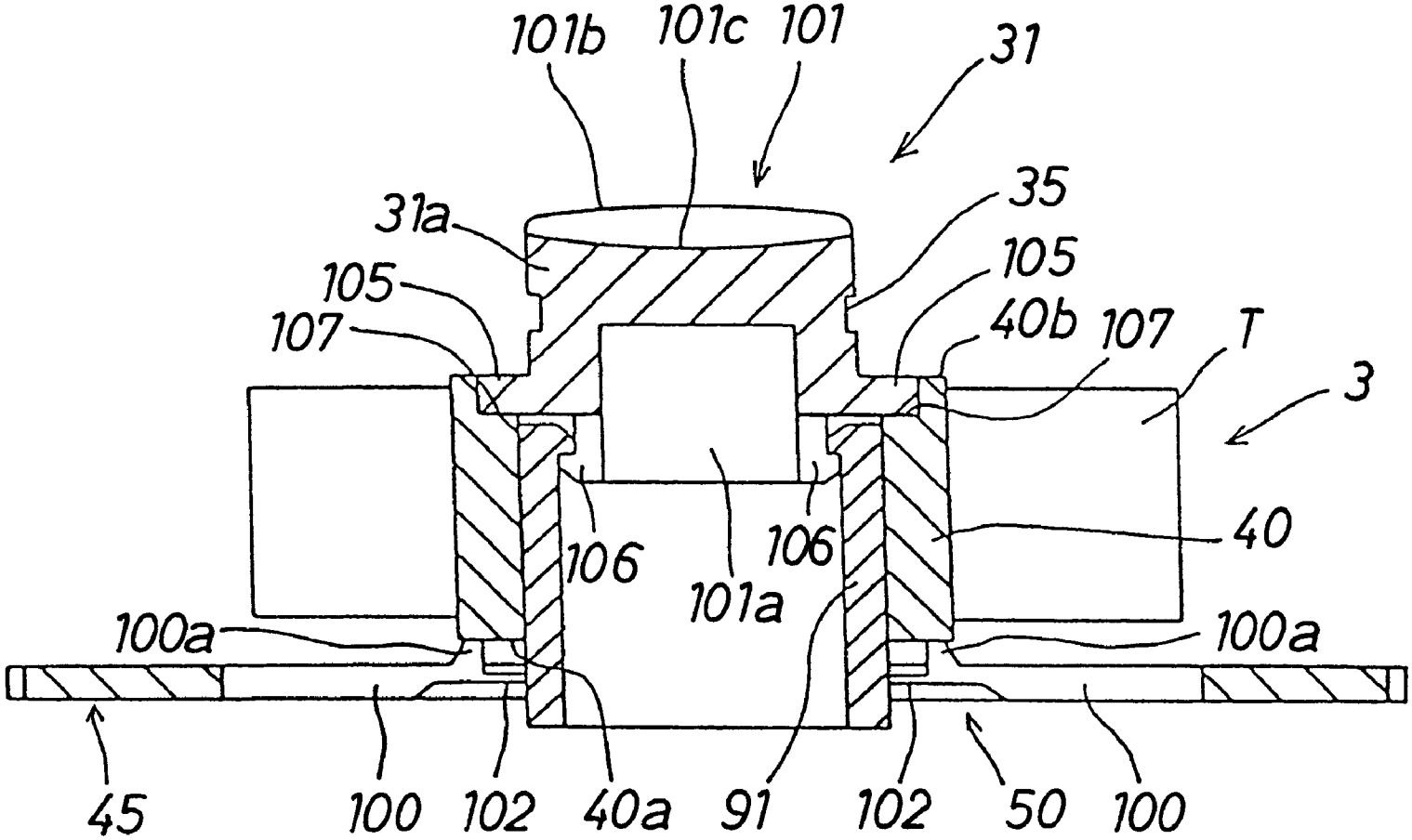
FIG. 10 is a front sectional view showing the pay-off reel side position of the tape cartridge of the eraser.
Figure 11:
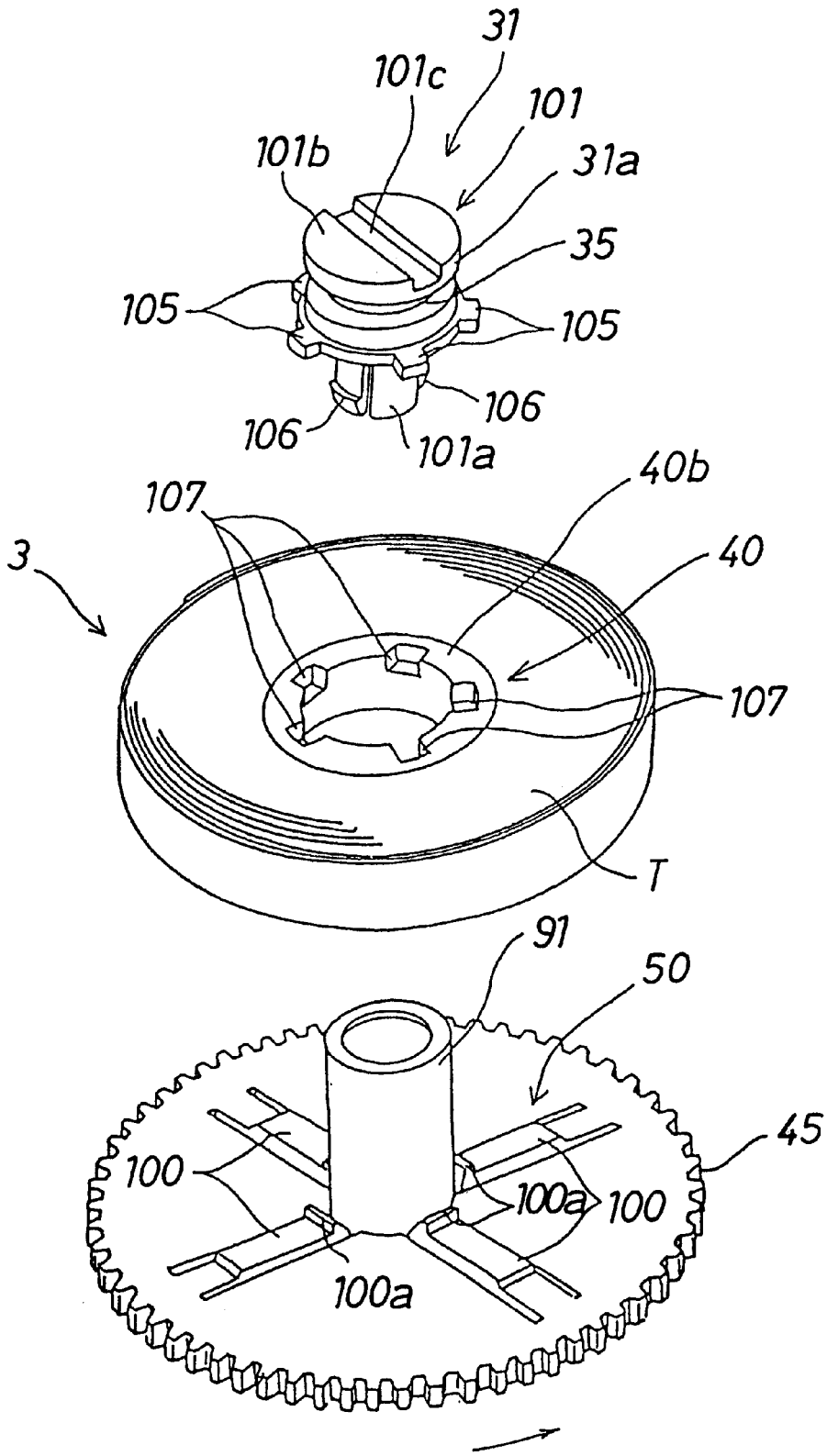
FIG. 11 is a perspective exploded view of the pay-off reel side position.
Figure 12:
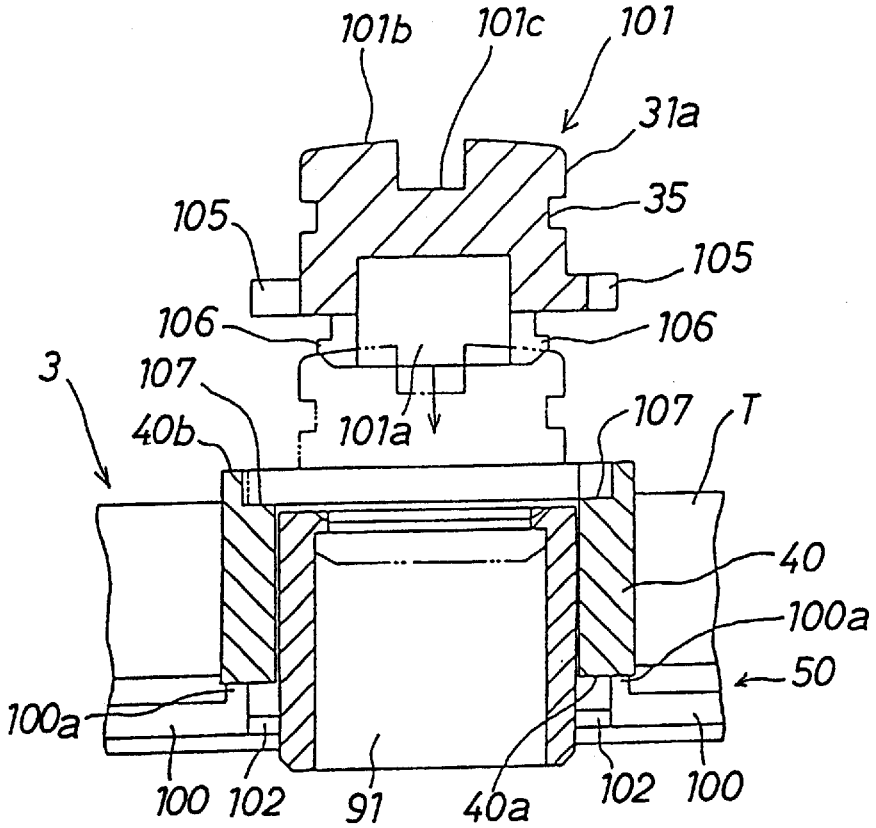
FIGS. 12(*a*)–12(*b*) are front sectional views for explaining the assembling procedure of the pay-off reel side position.
Figure 12:
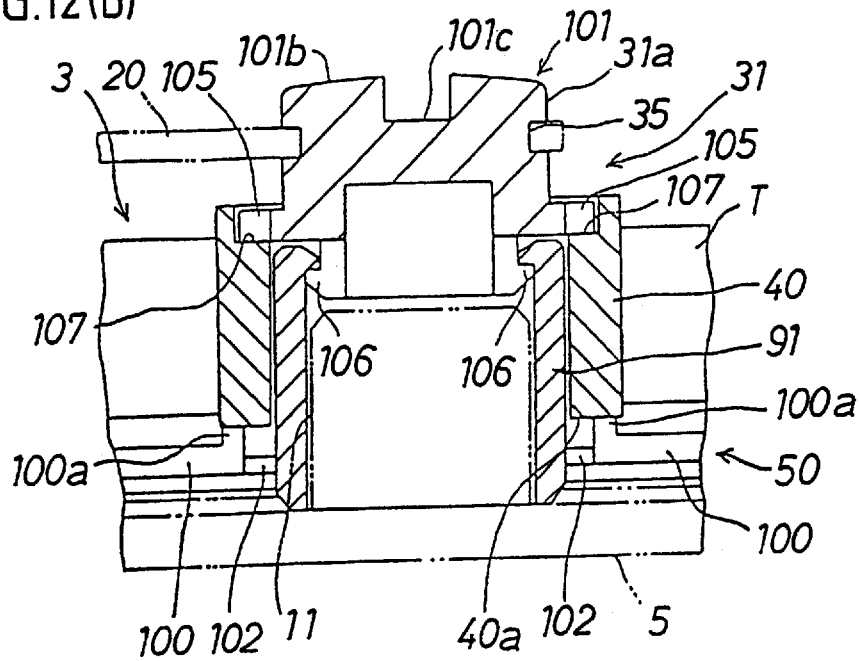

The clutch mechanism 50 of the embodiment is formed into a unit in the tape cartridge C together with the pay-off reel 3 and the pay-off rotary gear 45 of the tape interlock unit D, and is a replaceable consumable part, like the coat film transfer tape T. For this purpose, the specific structure of the clutch mechanism 50 is simple and inexpensive as explained below. A specific structure of the clutch mechanism 50 is shown in FIG. 10 to FIG. 12, and is mainly composed of a plurality of engaging protrusions 100, 100 . . . integrally formed in the pay-off rotary gear 45, and an engaging support member 101.

The engaging protrusions 100 function as frictional engaging members for composing the power transmitting means in the clutch mechanism 50, and are formed integrally as being extended inside the radial direction at a plurality of positions (four positions in the drawing) in the circumferential direction of the pay-off rotary gear 45. The engaging protrusion 100 is elastically deformable in the axial direction from the base part at its outer circumferential side, and has an engaging portion 100*a* bulged upward at the leading end portion at its inner circumferential side. In the illustrated embodiment, the leading end portion at the inner circumferential side of the engaging protrusion 100 is integrally connected and supported to the rotary drive unit 91 by means of a thin-wall connection piece 102 for reinforcement.

The engaging portion 100*a* of the engaging protrusion 100 projects upward from the upper surface of the pay-off rotary gear 45 in ordinary state at a position opposite to the axial end 40*a* of the tape core 40, and has an engaging plane corresponding to the plane of the axial end 40*a*.

The engaging support member 101 is specifically a rewind button, and functions also as a constituent member of tape rewinding mechanism for eliminating the slack of coat film transfer tape T between the both reels 3 4.

This rewind button 101 has an axial engaging portion 105 engaged with the axial end 40*b* of the tape core 40, and a detent pawl 106 engaged with the rotary drive unit 91.

The axial engaging portion 105 is an engaging bump projecting horizontally in the radial direction from the outer circumference of the rewind button 101, and functions also as a rotation engaging portion of the tape rewind mechanism, and five portions are provided at equal intervals in the circumferential direction in the illustrated example. In correspondence therewith, at the axial end 40*b* of the tape core 40, five engaging recesses 107 to be engaged with the axial engaging portions 105 are provided at equal intervals in the circumferential direction.

The detent pawl 106 is a vertical slit formed in a part of the mounting cylindrical portion 101*a* of the rewind button 101, and its leading end engaging portion is elastically deformable in the radial direction. In the illustrated example, a pair of detent pawls 106, 106 are provided oppositely on one diameter line of the mounting cylindrical portion 101*a*, and the leading end engaging portion of the detent pawl 106 is formed like a downward wedge.

In correspondence therewith, on the inner circumference of the rotary drive unit 91, there is an engaging flange 108 to be engaged with the detent pawl 106 in the axial direction. The inner diameter of the engaging flange 108 is set in a size enough to allow to insert the mounting cylindrical portion 101*a* of the rewind button 101, and fix by preventing the engaging leading end portion of the detent pawl 106 from slipping out.

Therefore, after inserting the tape core 40 of the pay-off reel 3 into the rotary drive unit 91, the rewind button 101 is inserted into the rotary drive unit 91 of the pay-off rotary gear 45 so that the axial engaging portions 105, 105 may correspond to the engaging recesses 107, 107, . . . of the tape core 40. As a result, the detent pawls 106, 106 of the rewind button 101 are elastically deformed inside in the radial direction on the engaging flange 108 of the rotary drive unit 91, and pass in the axial direction, and, by elastic restoration, are engaged with the engaging flange 108 to prevent from slipping out (see FIG. 12(*a*) to FIG. 12(*b*)).

Accordingly, the tape core 40 is held and supported from both sides in the axial direction by means of the engaging protrusions 100, 100, . . . of the pay-off rotary gear 45 and the axial engaging portions 105, 105, . . . of the rewind button 101, and at the same time, by the axial engaging force of the rotary drive unit 91 and rewind button 101, the engaging protrusions 100, 100, . . . of the pay-off rotary gear 45 are frictionally engaged with the axial end 40*a* of the tape core 40 elastically in the rotating direction with a specified pressing force.

That is, in power transmission of the clutch mechanism 50, the frictional engaging force by the thrust load acting between the axial end 40*a* of the tape core 40 and engaging protrusions 100, 100, . . . of the pay-off rotary gear 45 is utilized, and this frictional engaging force is set to an optimum value by properly adjusting the engaging dimensional relation of the rotary drive unit 91 and the rewind button 101 in the axial direction.

More specifically, in consideration of the spring constant and elastic deformation amount of the engaging protrusions 100, 100, . . . of the pay-off rotary gear 45, the relative axial positional relation between the tape core 40 and pay-off rotary gear 45 by the axial engaging portion 105 of the rewind button 101 and the detent pawl 106 is properly adjusted, and the frictional engaging force of the engaging protrusions 100, 100, . . . and the axial end 40*a* of the tap e core 40 is set to an optimum value.

When assembling the tape cartridge C, first, the composed units of pay-off reel 3, pay-off rotary gear 45, and rewind button 101 (see FIG. 11) are integrally assembled in the axial direction as shown in FIG. 10 and FIG. 12. In succession, the unit assemblies 3, 45, and 101, and the take-up reel 4 are mounted on the bearings 25, 26 of the support main body 20 in the procedure described above. Finally, the coat film transfer tape T forwarded from the pay-off reel 3 is set along the periphery of the coat film transfer head H as mentioned above, and the its leading end portion is connected to the take-up reel 4 so as to be wound up, and the tape cartridge C is completed.

The rewind button 101 is, as shown in FIG. 1, set opposite to the outside of the case 2 by way of the opening 14 formed in the cap body 6 of the case 2, and is set flush with or lower than the surface or the gripping side 2*a* of the case 2 (see FIG. 2). At the outer end of the rewind button 101, that is, the outer surface 101*b*, a linear operation groove 101*c* is formed as a rotation operating unit for rewind rotating operation, and a coin or a plate operating member such as the tightening cap 8 is detachably engaged with this operation groove 101*c*.

In thus completed tape cartridge C, moreover, to maintain the setting state (tight state) of the coat film transfer tape T, the support main body 15 is integrally provided with rotation stopping mechanism (rotation stopping means) 300 for stopping and holding the rotation of the pay-off reel 3.

This rotation stopping mechanism 300 is, as shown in FIG. 7, formed by injection molding, integrally with the support base plate 20 and protective wall 21 of the support main body 15, and is composed of a rotation stopper 301 to be engaged with the pay-off rotary gear 45 as the engaging portion of the pay-off reel 3, and a release engaging portion 302 which can be engaged with a rotation stop release part 305 provided in the cases main body 5.

Figure 13:
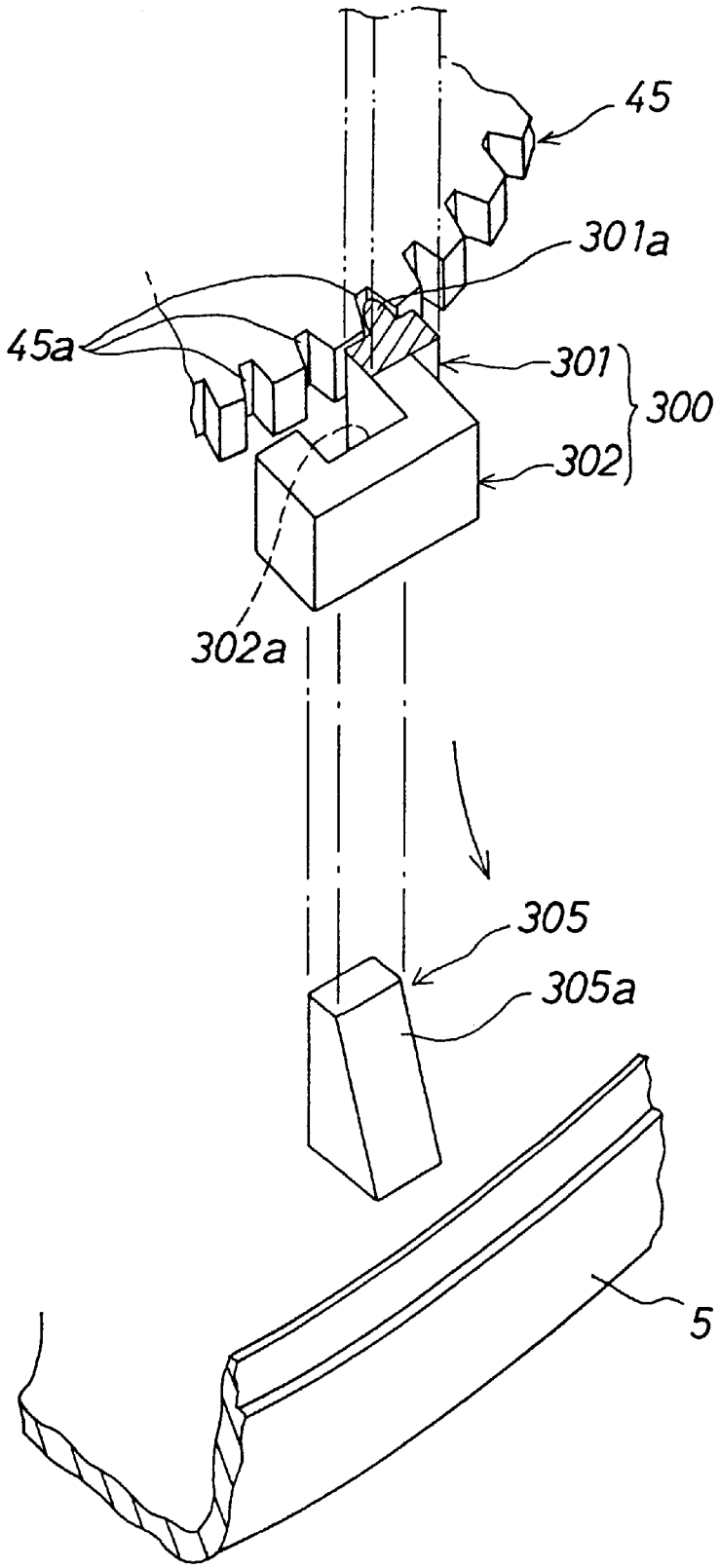
FIG. 13 is a perspective view of rotation stopping mechanism of the tape cartridge of the eraser.
Figure 14A:
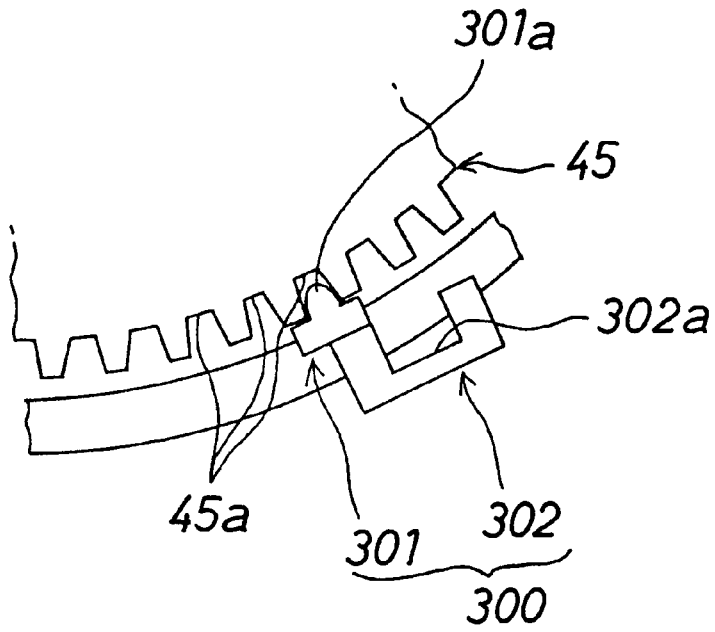
FIG. 14(*a*) is a plan view of working state of the rotation stopping mechanism, showing the rotation stopped state of the pay-off reel.
Figure 14B:
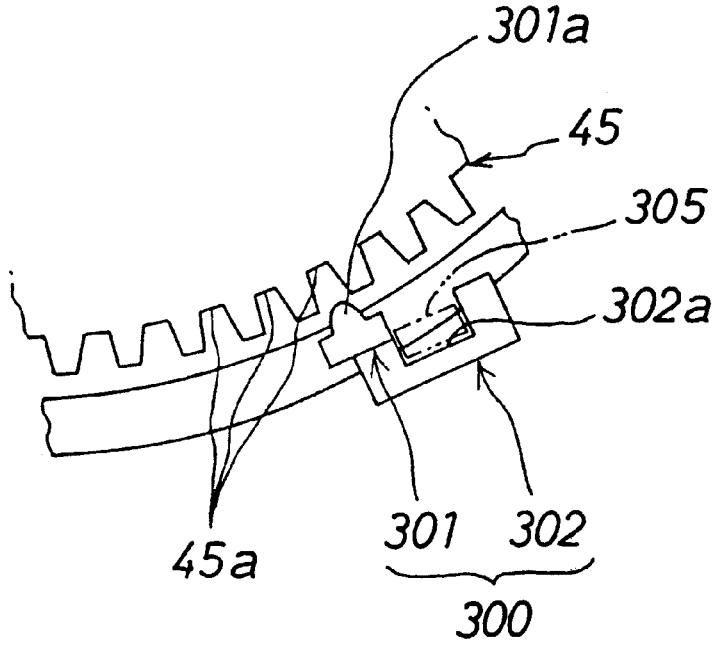

The rotation stopper 301 is, specifically, formed in a linear bar form to be deformed elastically, extending parallel to the protective wall 21 from the support base plate 20 of the support main body 15, and further, as shown in FIG. 13 and FIG. 14, its sectional shape has a protrusion 301*a* which is engaged with a bottom 45*a* of the outer teeth of the pay-off rotary gear 45 mounted on the support main body 15. That is, the protrusion 301*a* is formed toward the radial center of the pay-off rotary gear 45, and, in ordinary state, the free end side position of the rotation stopper 301 is elastically engaged with the bottom 45*a* of the outer teeth of the pay-off rotary gear 45.

The release engaging portion 302 is integrally formed at the free end of the rotation stopper 301, and has a shape and dimension to be engaged with the rotation stop release part 305 provided corresponding to the case 2. More specifically, the release engaging portion 302 has a pi-shaped section, as shown in FIG. 13 and FIG. 14, disposed toward the radial center of the pay-off rotary gear 45 same as the protrusion 301*a*.

The rotation stop release part 305 to be engaged with the release engaging portion 302 is formed integrally upright at a position corresponding to the rotation stop release part 305, at the inner side of the case main body 5. This rotation stop release part 305 has an engaging plane 305*a* formed on a flat plane toward the same direction as the engaging plane 302*a* of the release engaging portion 302, that is, in the radial center of the pay-off rotary gear 45, and this engaging plane 305*a* is an inclined engaging plane inclined to the radial center side of the pay-off rotary gear 45 toward its leading end as shown in FIG. 13.

The relative configuration of the engaging plane 305*a* and the protrusion 301*a* of the rotation stopper 301 is set as follows: in the engaged state of the release engaging portion 302 and rotation stop release part 305, as the support main body 15 approaches the inner side of the case main body 5, the engaging plane 302*a* of the release engaging portion 302 slides and is guided by the engaging plane 305*a* of the rotation stop release part 305, and the protrusion 301*a* of the rotation stopper 301 is gradually released outward in the radial direction from the bottom 45*a* of the outer teeth of the pay-off rotary gear 45 (arrow direction in FIG. 13), and finally the engaged state with the bottom 45*a* is cleared (see FIG. 14(*b*)).

In this constitution, in the state before the tape cartridge C is installed in the case 2, that is, while the release engaging portion 302 is not engaged with the rotation stop release part 305, the rotation stopper 301 is elastically engaged with the pay-off rotary gear 45 of the pay-off reel 3 from outside in the radial direction, and rotation of the pay-off reel 3 is stopped and held (see FIG. 14(*a*)). At this time, the take-up reel 4 is arrested of its reverse rotation by the reverse rotation preventive mechanism 95, and by the collaboration of the rotation stopping mechanism 300 and reverse rotation preventive mechanism 95, the rotation of the both reels 3, 5 is stopped and held as mentioned above.

On the other hand, in the state of the tape cartridge C being installed in the case 2, that is, when the release engaging portion 302 is engaged with the rotation stopping mechanism 305, the rotation stopper 301 is elastically deformed outward in the radial direction of the pay-off reel 3, and the engaged state with the engaging portion 45 of the pay-off reel 3 is cleared.

Referring now to FIG. 2 to FIG. 5, thus composed tape cartridge C is held by fingers, the pay-off rotary gear 45 is being engaged with the take-up rotary gear 46 mounted on the rotary support shaft 12 of the case main body 5, and the rotary shaft 91 of the pay-off rotary gear 45 and the tape core 41 of the take-up reel 4 are respectively engaged with the rotary support shaft 11 of the case main body 5 and the rotary shaft 46*a* of the take-up rotary gear 46 from upper side, and at the same time the coat film transfer head H is positioned and inserted into the insertion groove 10*a* which is the head holder of the case main body 5, so as to be set instantly.

At this time, the positioning engaging portions 38, 38, . . . of the support main body 15 are simultaneously engaged respectively with the positioning engaging portions 37, 37, . . . of the case main body 5, and also the release engaging portion 302 of the rotation stopping mechanism 300 is engaged with the rotation stop release part 305, so that the engaged state of the rotation stopper 301 and engaging portion 45 of the pay-off reel 3 is cleared. In the positioned state of the support main body 15, the support main body 15 cooperates with the rotary support shafts 11, 12, thereby rotating and supporting the pay-off reel 3 and take-up reel 4 at both sides.

On the other hand, by picking the support main body 15 by fingers and directly lifting to the upper side, the pay-off rotary gear 45, tape core 41, and coat film transfer head H can be detached easily and instantly from the rotary support shaft 11, rotary shaft 46*a* of the take-up rotary gear 46, and insertion groove 10*a*, respectively.

In this way, with the tape cartridge C being installed in the case main body 5, when the cap body 6 is put on the case main body 5 to prevent from moving and lock in the procedure mentioned above, the coat film transfer tool 1 is completed. In this case, the rewind button 101 is opposite to outside through the opening 14 of the cap body 6, and the coat film transfer head H projects outside through the head insertion part 10.

In this case, the coat film transfer head H can rotate about the head axial center in a rotating angle range of the operation lever 70 of the rotary operation unit 62 defined by the operation guide 72, and the coat film transfer head H can be held in an optimum state according to the purpose or the user's manner of holding.

That is, when correcting wrong letters by thus constituted coat film transfer tool 1, whether the user is right-handed or left-handed, as mentioned above, the operation lever 70 can be rotated and manipulated according to the purpose, and an optimum tape pressing and transferring position of the head main body 60 of the coat film transfer head H can be selected and set (for example, first defining position A shown in FIG. 9(*a*), second defining position B shown in FIG. 9(*b*), and third defining position C shown in FIG. 9(*c*)), and the gripping sides of the case 2 corresponding to the position are held by fingers (the standard gripping sides are face and back surfaces 2*a*, 2*b* of the case 2, and other sides of the case 2 may be also held depending on the purpose), so that various manners of use are realized as shown in FIG. 15 to FIG. 18.

In any manner of use, the gripping sides of the case 2 are held by fingers in the same manner as when holding a writing tool, and the leading end pressing portion 63 of the coat film transfer head H is pressed tightly to the start end of the correction area (transfer area) 110 on the sheet of paper to correct wrong letters, and the case 2 is moved directly along the sheet of paper, and stopped at the end (right end) of the correction area 110.

By this manipulation, the correction paint layer (white) 111 of the coat film transfer tape T in the pressing portion 63 of the coat film transfer head H is peeled off from the film base material, and is transferred and applied on the correction area 110. As a result, wrong letters are erased, and correct letters can be immediately written over.

On the other hand, the head main body 60 of the coat film transfer head H is freely rotatable about its axial center, while maintaining the standard tape pressing and transferring position set by the operation lever 70, and therefore not only the linear portion such as a line of characters, but also curves and other figures as shown in FIG. 15(*b*), FIG. 17(*b*), and FIG. 18(*b*) can be corrected neatly along the curvature.

Turning attention to the inside mechanism and operation of the coat film transfer tool 1, by such pressing manipulation of the coat film transfer head H, when the pulling force (arrow X direction in FIG. 4) applied on the coat film transfer tape T acts on the pay-off reel 3 as a rotary torque, the pay-off rotary gear 45 is put into rotation through the tape core 40 of the pay-off reel 3 and also the clutch mechanism 50. This rotating force causes to rotate the take-up rotary gear 46 and the take-up reel 4 integral therewith in the rotating direction in cooperation by means of the tape interlock unit D, thereby automatically winding up the used coat film transfer tape T'.

In this case, the rotation ratio (corresponding to the gear ratio of the tape interlock unit D) of the pay-off rotary gear 45 and take-up rotary gear 46 is always constant, but the ratio of the outer diameter of the coat film transfer tape T on the pay-off reel 3 and the outer diameter of the used coat film transfer tape T' on the take-up reel 4 is always changing and is not constant. That is, as the use is repeated, the outer diameter of the coat film transfer tape T on the pay-off reel 3 gradually decreases, while the outer diameter of the used coat film transfer tape T' on the take-up reel 4 increases to the contrary.

As a result, the take-up speed of the take-up reel 4 becomes gradually faster than the pay-off speed of, the pay-off reel 3, and the synchronism of the two speeds is broken, and the rotary torque acting on the pay-off reel 3 gradually increases. Consequently, the rotary torque overcomes the frictional force of the clutch mechanism 50, and the tape core 40 slips and rotates on the pay-off rotary gear 45, and the difference in rotary torque between the two reels 3, 4 is canceled, and the pay-off speed is synchronized with the take-up speed, so that smooth running of the coat film transfer tape T is assured.

As mentioned above, since the power transmission in the clutch mechanism 50 makes use of the frictional force by the thrust load between the tape core 40 and the engaging protrusions 100, 100, . . . of the pay-off rotary gear 45, in the configuration of the clutch mechanism 50, by properly adjusting the dimensional relation of the mutual constituent members 3, 45, 91 in the thrust direction, the frictional force can be set at an optimum value.

Incidentally, if a slack of coat film transfer tape T occurs between the pay-off reel 3 and take-up reel 4 due to handling error by the user or the like, by manipulating the rewind button 101 in the rewind direction from outside of the case 2 (rotation in arrow Y direction in FIG. 4), the slack of the coat film transfer tape T can be eliminated.

In this case, the rotating force in the rewinding direction Y applied to the rewind button 101 is directly transmitted to the tape core 40 through the rotating engaging portions 105, 105, . . . serving also as axial engaging portions, and the tape core 40 rotates in the rewind direction Y. On the other hand, by the reverse rotation inhibiting force of the reverse rotation preventive mechanism 95 and the slip action of the clutch mechanism 50, the rotary gears 45, 46 of the tape interlock unit D and the tape core 41 of the take-up reel 4 are in stopped state. As a result, the slack of the coat film transfer tape T between the two reels 2, 3 is eliminated.

By the use of the coat film transfer tool 1, when the coat film transfer tape T wound on the pay-off reel 3 is completely wound up and collected on the take-up reel 4 as used tape T', the entire tape cartridge C is replaced with a new tape cartridge, and this replacement is done instantly.

That is, as mentioned earlier, in the tape cartridge C, the support main body 15 is composed to support rotatably the opposite side ends 31*a*, 32*a* of the rotary shafts 31, 32 of the both reels 3, 4 supported on the rotary support shafts 11, 12 of the case 2, and setting of the coat film transfer tape T on the coat film transfer head H has been already completed in the stage of the product.

Accordingly, the user, gripping the support main body 15, has only to cause the rotary shaft 31 (specifically the rotary shaft 91 of the pay-off rotary gear 45) and rotary shaft 32 (specifically the tape core 41) of the both reels 3, 4 to be engaged with the rotary support shaft 11 and rotary support shaft 12 (specifically the rotary shaft 46*a* of the take-up rotary gear 46) of the case 2 from the upper side, and put the tape cartridge C into the case 2 while positioning the coat film transfer head H at the leading end specified position of the case 2, that is, in the insertion groove 10*a* (this positioning is done easily by positioning means positions 37, 38, . . . ), so that the replacement is over. At the same time, the rotation stopped state of the pay-off reel 3 by the rotation stopping mechanism 300 is also cleared.

In thus constituted coat film transfer tool 1, the support main body 15 of the tape cartridge C includes the support base plate 20 which rotatably supports the opposite-side ends 31*a*, 32*a* of the rotary shafts 31, 32 of the pay-off reel 3 and take-up reel 4 detachably and rotatably supported on the rotary support shafts 11, 12 of the case 2 of the coat film transfer tool 1, and this support base plate 20 has a flat plate skeletal structure having an outer contour corresponding to the inner contour of the case 2, and therefore as compared with the conventional plastic container, the rate of the amount of materials used for the support main body 15 in the entire device is substantially decreased.

The support main body 15 is also provided integrally with the rotation stopping mechanism 300 for stopping and holding the rotation of the pay-off reel 3, and the conventional independent rotation stopping member which is to be discarded after use is not required at all, so that the number of parts may be curtailed.

Embodiment 2

Figure 19A:
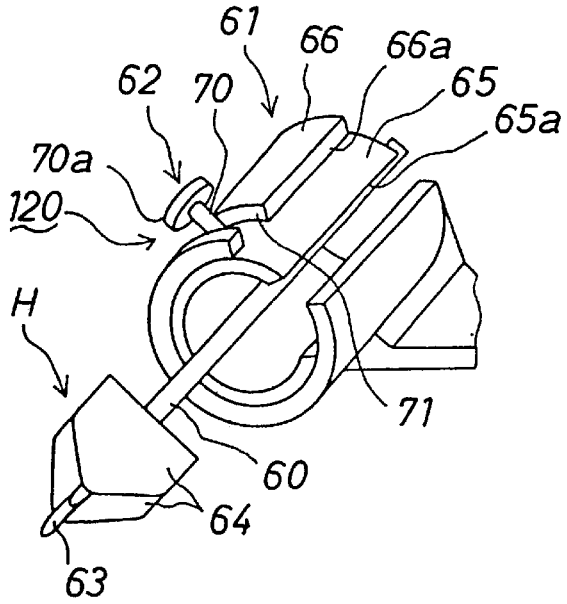
FIGS. 19(*a*)–19(*c*) are perspective views showing the structure of a coat film transfer head of an eraser in embodiment 2 of the invention.
Figure 19B:
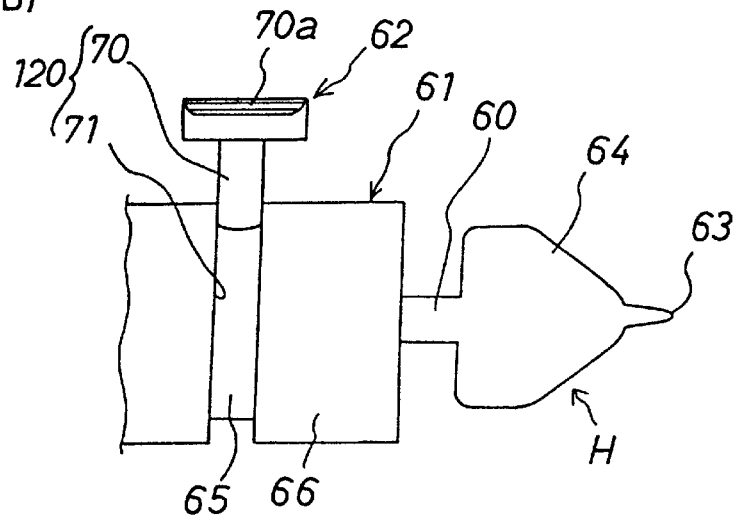
Figure 19C:
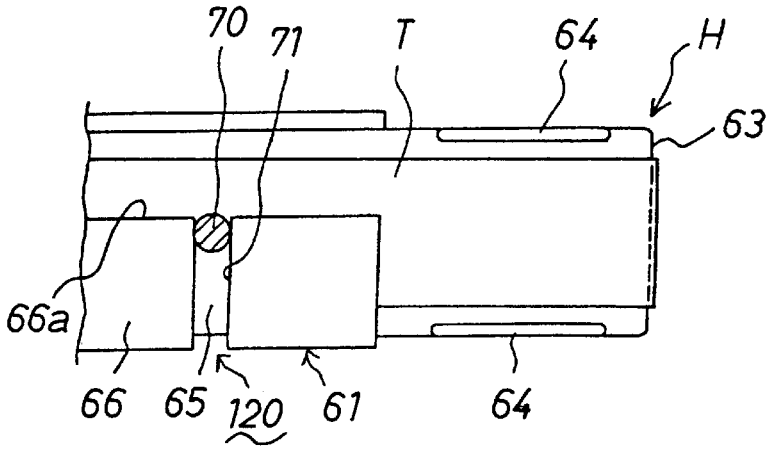

This embodiment is shown in FIG. 19, in which the structure of the coat film transfer head H is modified.

That is, the coat film transfer head H of the embodiment includes positioning means 120 for positioning and holding the head main body 60 steplessly around the axial center.

This positioning means 120 is specifically composed of the operation lever 70 provided in the supported portion 65 of the head holder 61, and the insertion part 71 provided in the bearing 66.

The insertion part 71 is set in the width dimension enough to be engaged with the operation lever 70 elastically to be held from its both sides, and functions as the positioning engaging portion of the operation lever 70.

In such configuration, the head main body 60 of the coat film transfer head H holds the tape pressing and transferring position freely selected and set by the operation lever 70, stably with a certain fixing force during use.

The other structure and action are same as in embodiment 1.

Embodiment 3

Figure 20A:
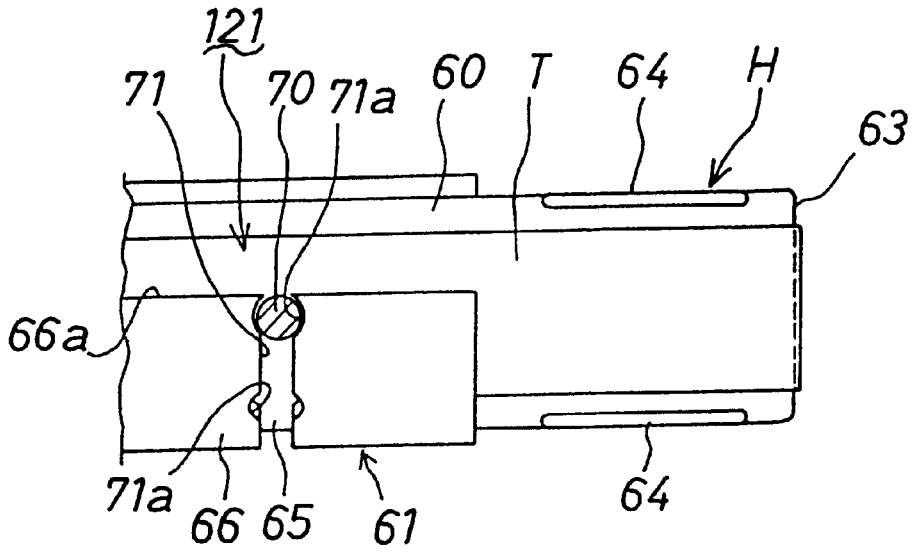
FIGS. 20(*a*)–20(*b*) are perspective views showing the structure of a coat film transfer head of an eraser in embodiment 3 of the invention.
Figure 20:
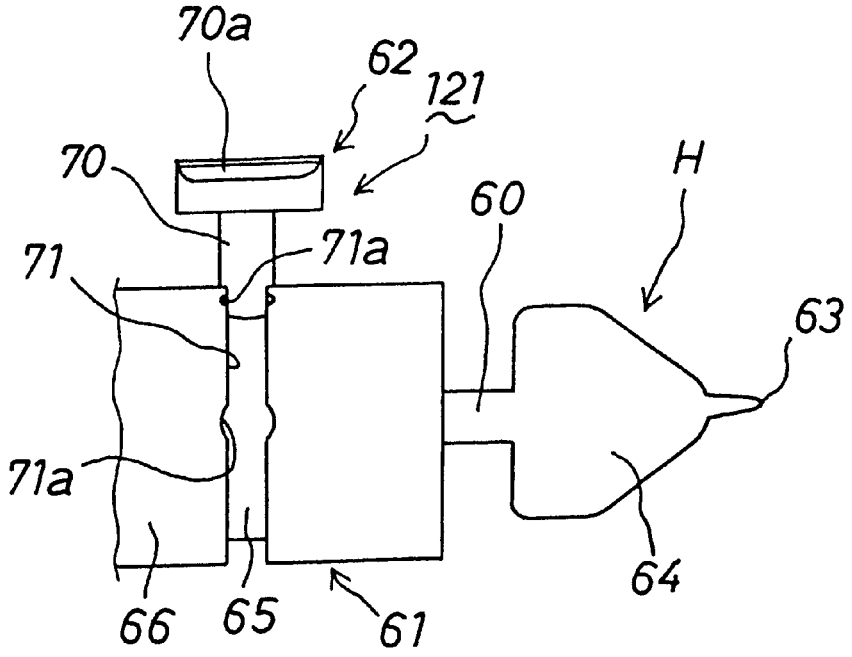

This embodiment is shown in FIG. 20, in which the structure of the coat film transfer head H is modified.

That is, the coat film transfer head H of the embodiment includes positioning means 121 for positioning and holding the head main body 60 at plural steps around the axial center. This positioning means 121 is specifically composed of, same as in embodiment 2, the operation lever 70 provided in the supported portion 65, and the insertion part 71 provided in the bearing 66.

This insertion part 71 functioning as the positioning engaging portion is, same as in embodiment 2, set in the width dimension enough to be engaged with the operation lever 70 elastically to be held from its both sides, and further at the specified position in the longitudinal direction, positioning recesses 71*a*, 71*a*, . . . for positioning and accommodating the operation lever 70 are provided at specific intervals.

In such configuration, the head main body 60 of the coat film transfer head H holds the tape pressing and transferring position selected and set at steps by the operation lever 70, stably with a certain fixing force during use. The other structure and action are same as in embodiment 1.

Embodiment 4

Figure 21:
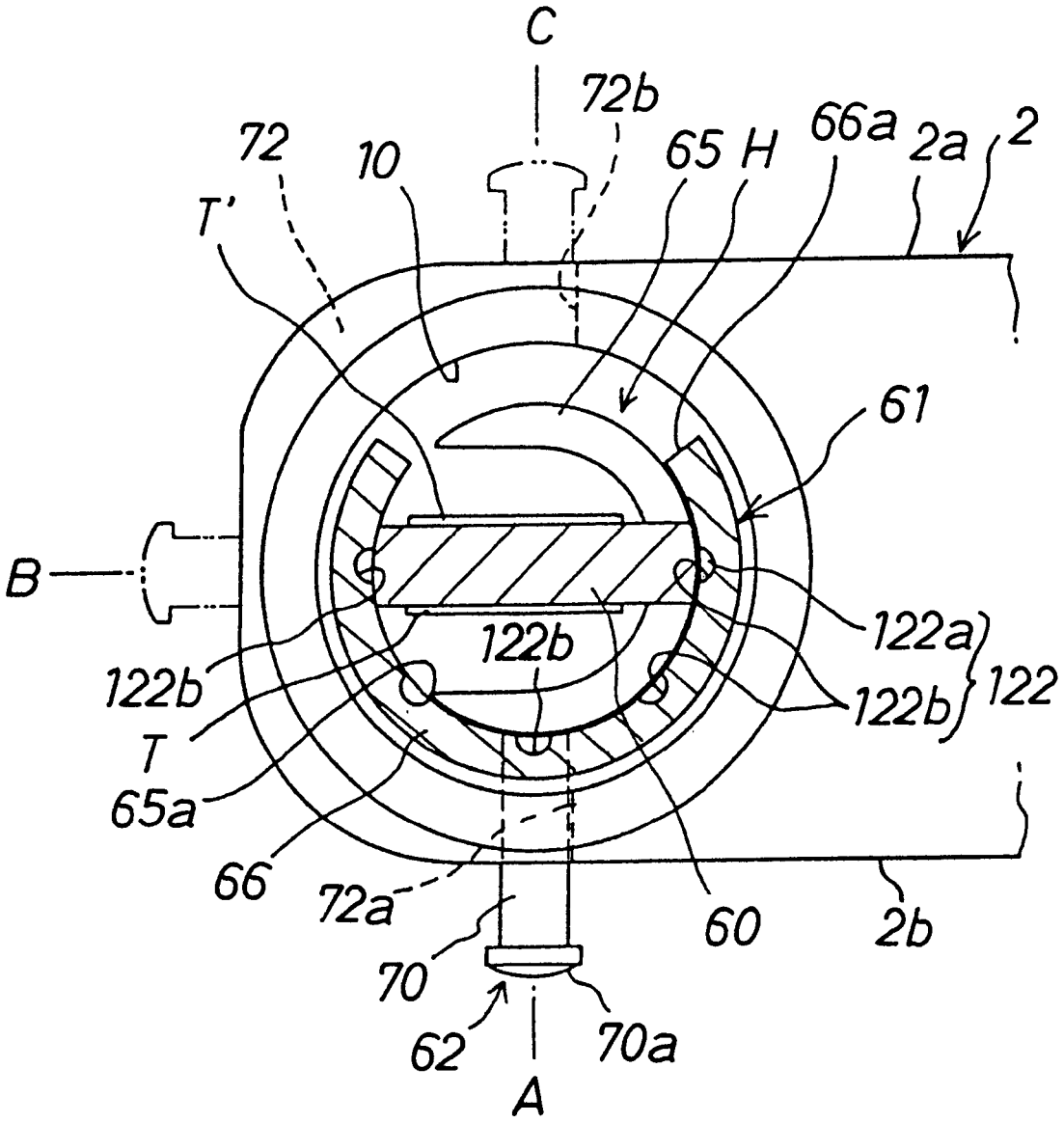
FIG. 21 is a perspective view showing the structure of a coat film transfer head of an eraser in embodiment 4 of the invention.
Figure 22A:
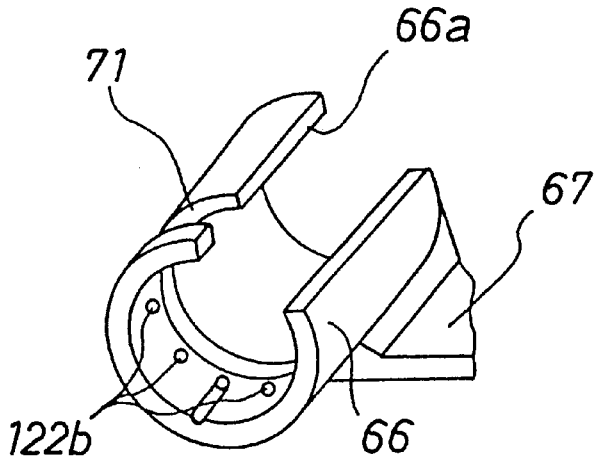
FIG. 22(*a*) is a perspective view showing a bearing of the coat film transfer head.
Figure 22B:
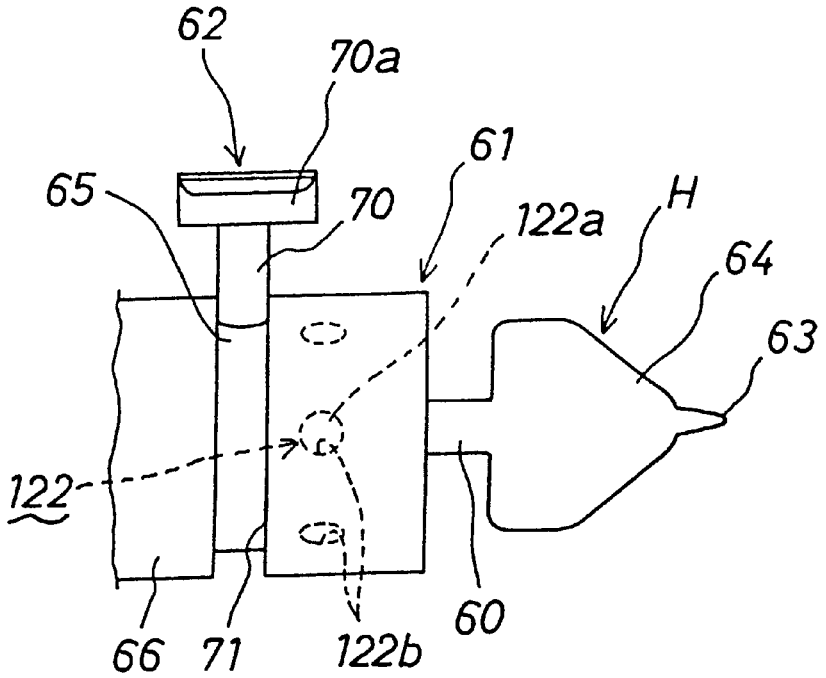

This embodiment is shown in FIG. 21 and FIG. 22, in which the structure of the coat film transfer head H is modified.

That is, the coat film transfer head H of the embodiment includes, same as in embodiment 3, positioning means 122 for positioning and holding the head main body 60 at plural steps around the axial center.

This positioning means 122 is composed of an engaging bump 122*a* provided on the cylindrical outer circumference of the supported portion 65, and engaging recesses 122*b*, 122*b*, . . . provided corresponding to the engaging bump 122*a* at specific intervals in the circumferential direction on the cylindrical inner circumference of the bearing 66, and the engaging bump 122*a* and any one of the engaging recesses 122*b*, 122*b*, . . . are elastically positioned and engaged with each other.

In such configuration, the head main body 60 of the coat film transfer head H, same as in embodiment 3, holds the tape pressing and transferring position selected and set at steps by the operation lever 70, stably with a certain fixing force during use.

Incidentally, the structural relation of the engaging bump 122*a* and the engaging recesses 122*b*, 122*b*, . . . may be reverse to the illustrated case.

The other structure and action are same as in embodiment 1.

Embodiment 5

Figure 23:
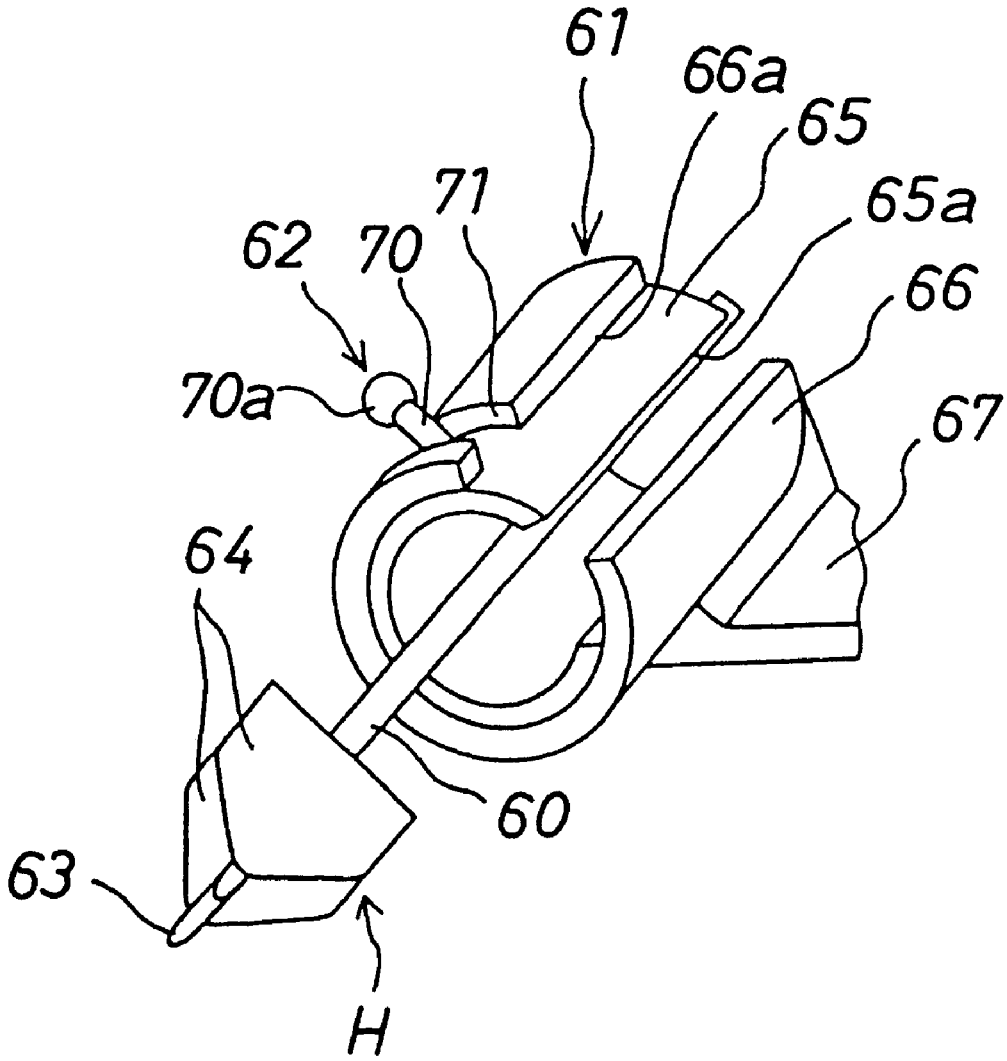
FIG. 23 is a perspective view showing the structure of a coat film transfer head of an eraser in embodiment 5 of the invention.

This embodiment is shown in FIG. 23, in which the shape of the operation lever 70 is slightly modified from the case of embodiment 1.

That is, in embodiment 1, the operation knob 70*a* of the operation lever 70 is a flat disk, but it is a spherical form in this embodiment. The other structure and action are same as in embodiment 1.

Embodiment 6

Figure 24A:
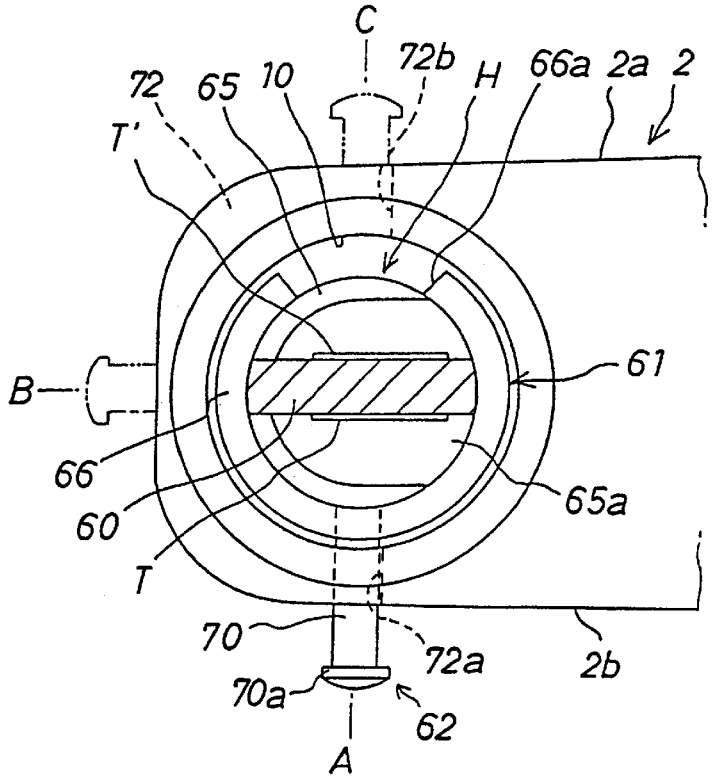
FIGS. 24(*a*)–24(*b*) are partial sectional side views showing the structure of a coat flim transfer head of an eraser in embodiment 6 of the invention.
Figure 24B:
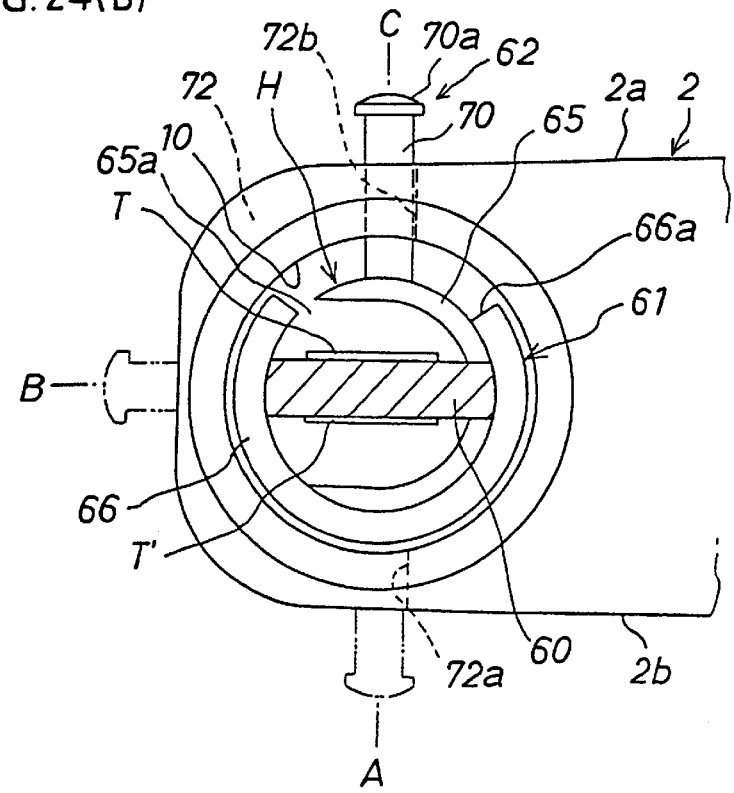

This embodiment is shown in FIG. 24, in which the structure of the coat film transfer head H is slightly modified.

That is, the opening position of the setting opening 65*a* in the supported portion 65 is set at a position rotated by 180° from the case of embodiment 1.

In such configuration, in the rotation range defined by the operation lever 70 and operation guide 72 (range from FIG. 24 (*a*) to (*b*)), the supported portion 65 and the bearing 66 are supported slidably and rotatably always with a cylindrical surface contacting relation.

The other structure and action are same as in embodiment 1.

Embodiment 7

Figure 25:
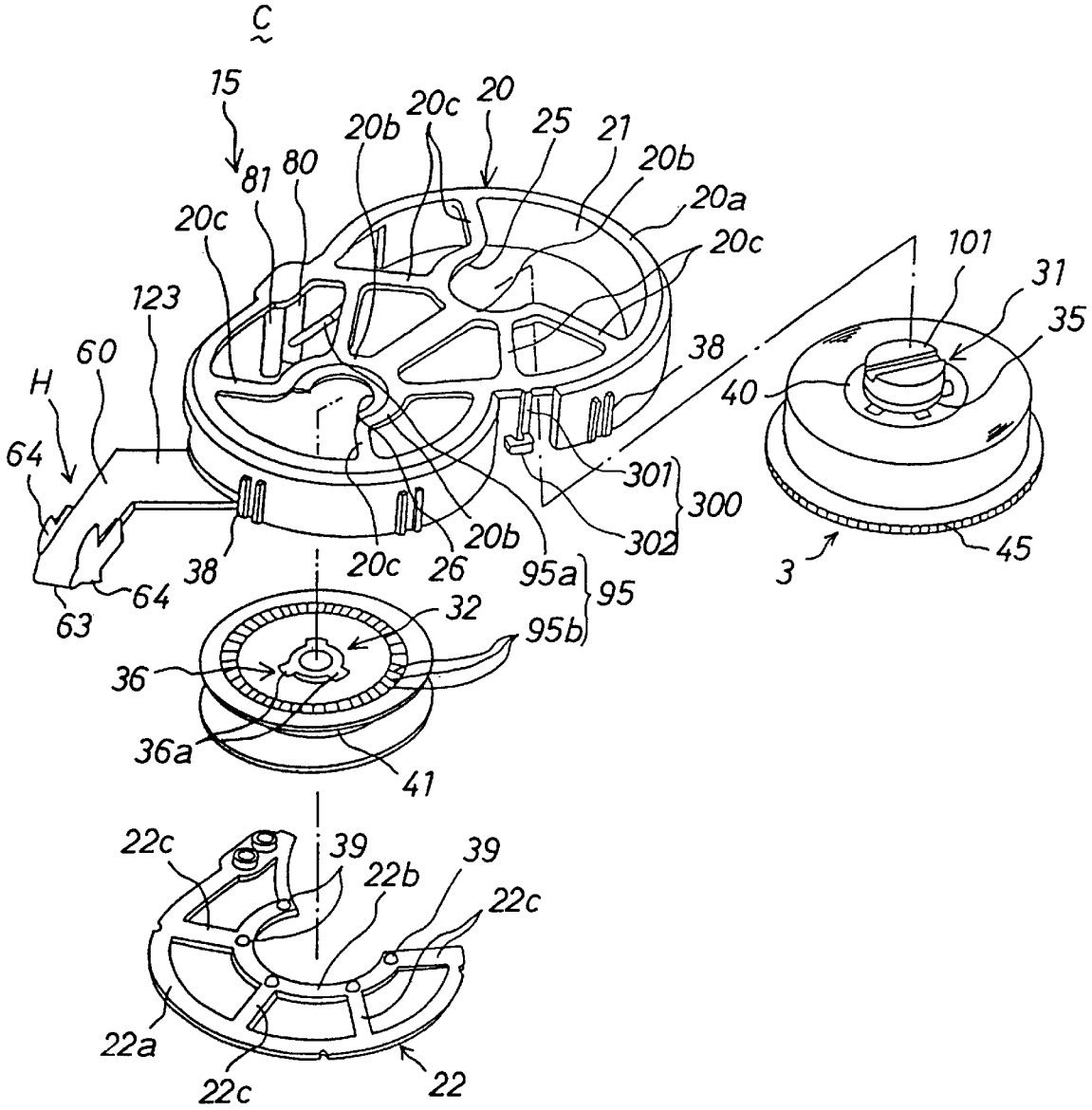
FIG. 25 is a perspective exploded view of a tape cartridge of an eraser in embodiment 7 of the invention.

This embodiment is shown in FIG. 25, in which the structure of the coat film transfer head H is modified.

That is, in the embodiment, the leading end pressing part 63 of the coat film transfer head H is a linear edge extending almost vertically to the rotary axial line of the both reels 3, 4 supported on the support base plate 20, and is designed exclusively for lateral pulling use.

In this relation the coat film transfer head H has its base end 123 integrally attached to the support main body 15, and is formed as an elastically deformable plate. The other structure and action are same as in embodiment 1.

Embodiment 8

Figure 26A:
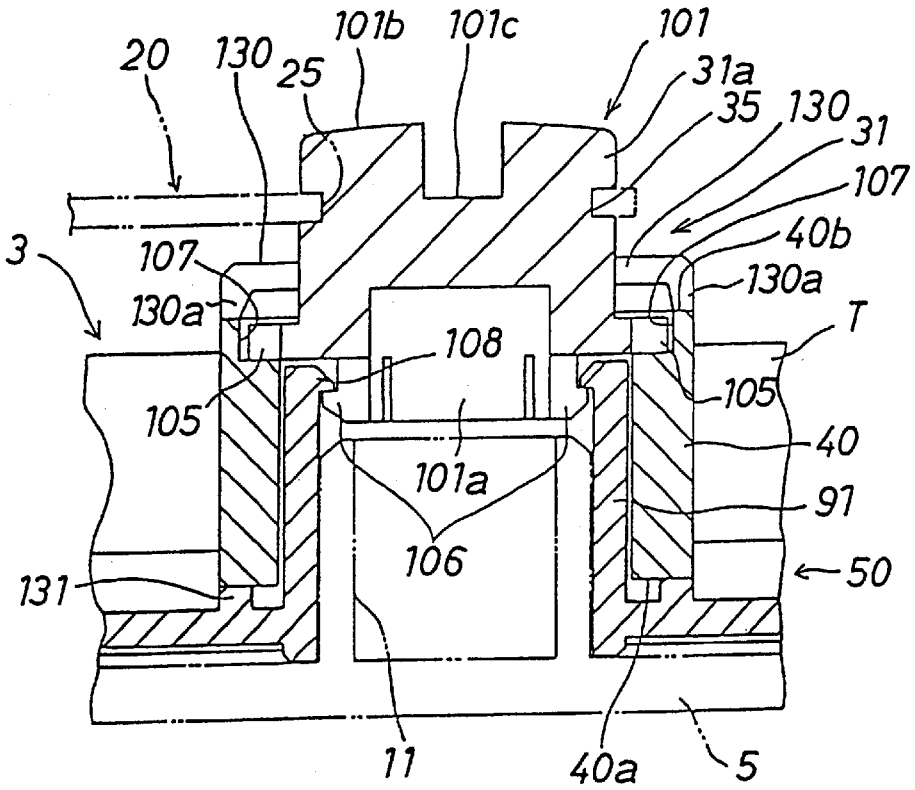
FIG. 26(*a*) is a front sectional view showing the pay-off reel side position which is a principal part of a tape cartridge of an eraser in embodiment 8 of the invention.
Figure 26B:
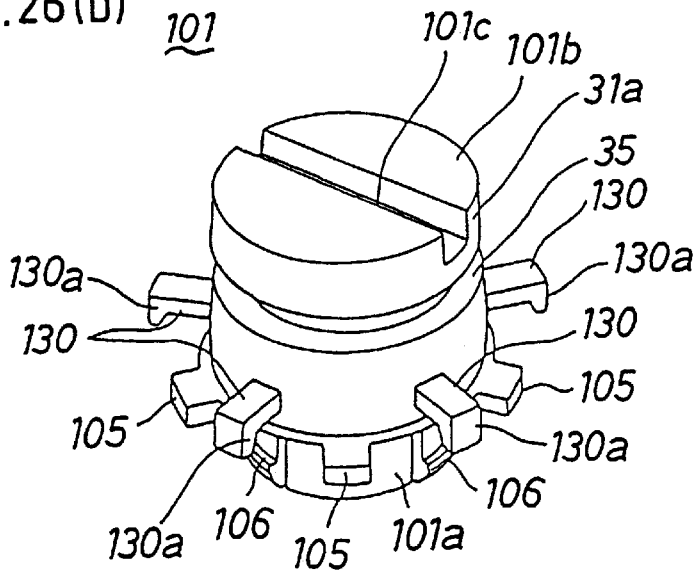

This embodiment is shown in FIG. 26, in which the structure of the clutch mechanism 50 is modified.

That is, in the clutch mechanism 50 of the embodiment, engaging protrusions 130, 130, . . . are provided in the rewind button 101.

More specifically, the engaging protrusions 130 are formed integrally, extending horizontally in the radial direction, at plural positions (five positions in the drawing) in the circumferential direction of the rewind button 101. The engaging protrusions 130 are elastically deformable in the axial direction from the base part of its inner circumferential side, and include an engaging portion 130*a* bulging downward at the outer side leading end portion. In the illustrated embodiment, considering the ease of forming of the rewind button 101 by injection molding, the engaging protrusions 130 are positioned at equal intervals between the axial engaging portions 105 and 105.

The engaging portion 130*a* of the engaging protrusions 130 is disposed at a position corresponding to the axial end face 40*b* of the tape core 40, and has a flat plane of the axial end face 40*b*, that is, an engaging flat plane corresponding to the outer circumference of the engaging recesses 107, 107 . . .

Corresponding to the composition of the engaging protrusions 130, 130, . . . , an engaging rib 131 is formed on the upper surface of the pay-off rotary gear 45, corresponding to the flat outer side of the axial end face 40*a* of the tape core 40, and the axial end face 40*a* is supported in frictional engagement state. As the detent pawls 106, 106 of the rewind button 101 are engaged with the engaging flange 108 of the rotary shaft 91 to prevent from slipping out, the tape core 40 is supported, being held at both sides in the axial direction, by the engaging rib 131 of the pay-off rotary gear 45 and the engaging protrusions 130, 130, . . . of the rewind button 101.

The engaging protrusions 130, 130, . . . are elastically engaged frictionally with the axial end face 40*b* of the tape core 40 in the rotating direction with a specified pushing force, and the power of the clutch mechanism 50 is transmitted, same as in embodiment 1, by making use of the frictional engaging force by the thrust load acting on the axial end face 40*b* of the tape core 40 and the engaging protrusions 130, 130, . . . of the rewind button 101.

In this case, the frictional engaging force is set by properly adjusting the engaging dimensional relation of the pay-off rotary gear 45 and rewind button 101 in the axial direction, which is same as in embodiment 1, but in this embodiment, however, the axial engaging portion 105 of the rewind button 101 functions only as the rotary engaging portion of the tape rewinding mechanism, and does not function as axial engaging portion. In the embodiment, instead, the engaging protrusions 130, 130, . . . function as the axial engaging portion. Therefore, in the engaged state of the detent pawls 106, 106 and the engaging flange 108, the dimensional relation is designed so that the engaging portions 105, 105, . . . may be engaged with the engaging recesses 107, 107, . . . of the axial end face 40*b* of the tape core 40 only in the rotating direction, and not engaged in the axial direction.

The other structure and action are same as in embodiment 1.

Embodiment 9

Figure 27:
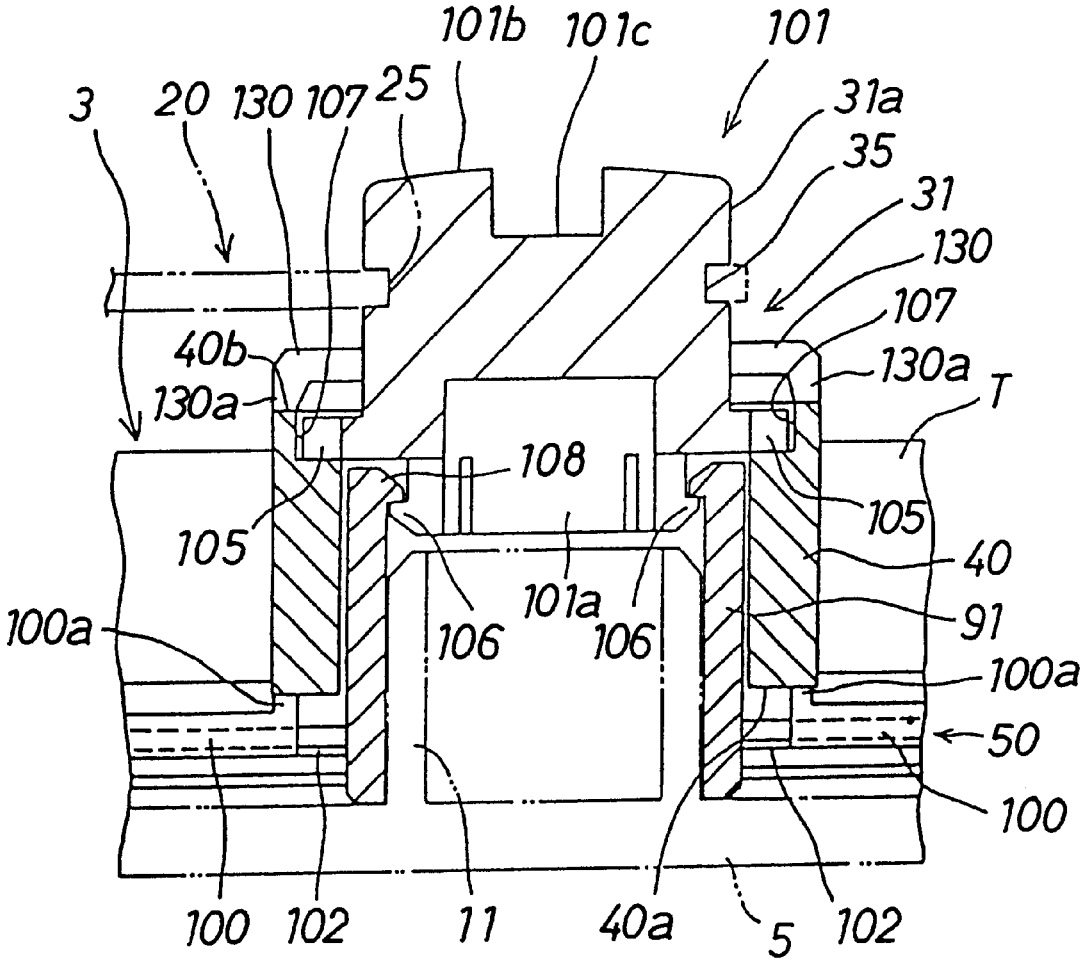
FIG. 27 is a front sectional view showing the pay-off reel side position which is a principal part of a tape cartridge of an eraser in embodiment 9 of the invention.

This embodiment is shown in FIG. 27, in which the structure of the clutch mechanism 50 is modified.

That is, in the clutch mechanism 50 of the embodiment, the structure of embodiment 1 (FIG. 1 to FIG. 18) and the structure of embodiment 8 (FIG. 26) are combined.

Specifically, engaging protrusions 100, 100, . . . are formed integrally in the pay-off rotary gear 45, and engaging protrusions 130, 130, . . . are formed integrally in the rewind button 101, and the structure of the engaging protrusions 100, 130 is respectively same as in embodiment 1 and embodiment 8.

As the detent pawls 106, 106 of the rewind button 101 are engaged with the engaging flange 108 of the rotary shaft 91 to prevent from slipping out, the tape core 40 is supported, being held at both sides in the axial directions, by the engaging protrusions 100, 100, . . . of the pay-off rotary gear 45 and the engaging protrusions 130, 130, . . . of the rewind button 101.

The engaging protrusions 100, 130, . . . are elastically engaged frictionally with the axial end faces 40*a*, 40*b* of the tape core 40 in the rotating direction with a specified pushing force, and the power of the clutch mechanism 50 is transmitted, by making use of the frictional engaging force acting between the axial end faces 40*a*, 40*b* of the tape core 40 and the engaging protrusions 100, 130, . . .

The other structure and action are same as in embodiment 1.

Embodiment 10

Figure 28:
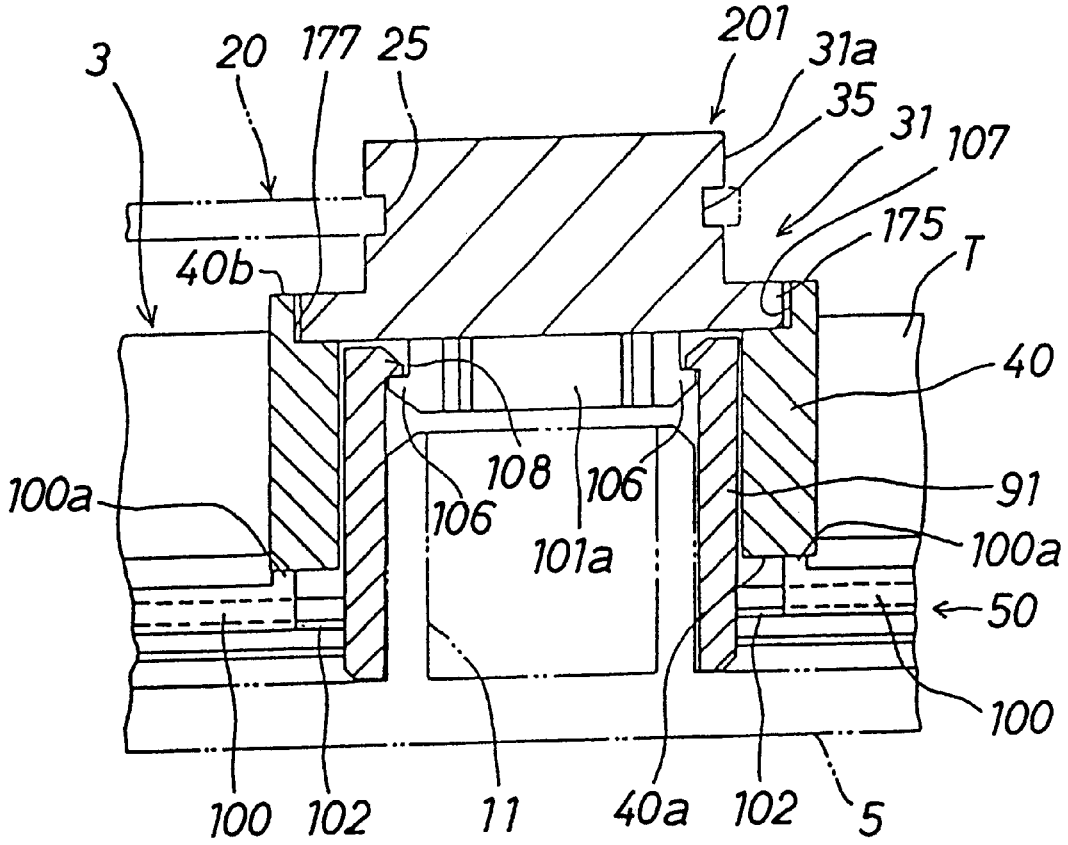
FIG. 28 is a front sectional view showing the pay-off reel side position which is a principal part of a tape cartridge of an eraser in embodiment 10 of the invention.
Figure 29:
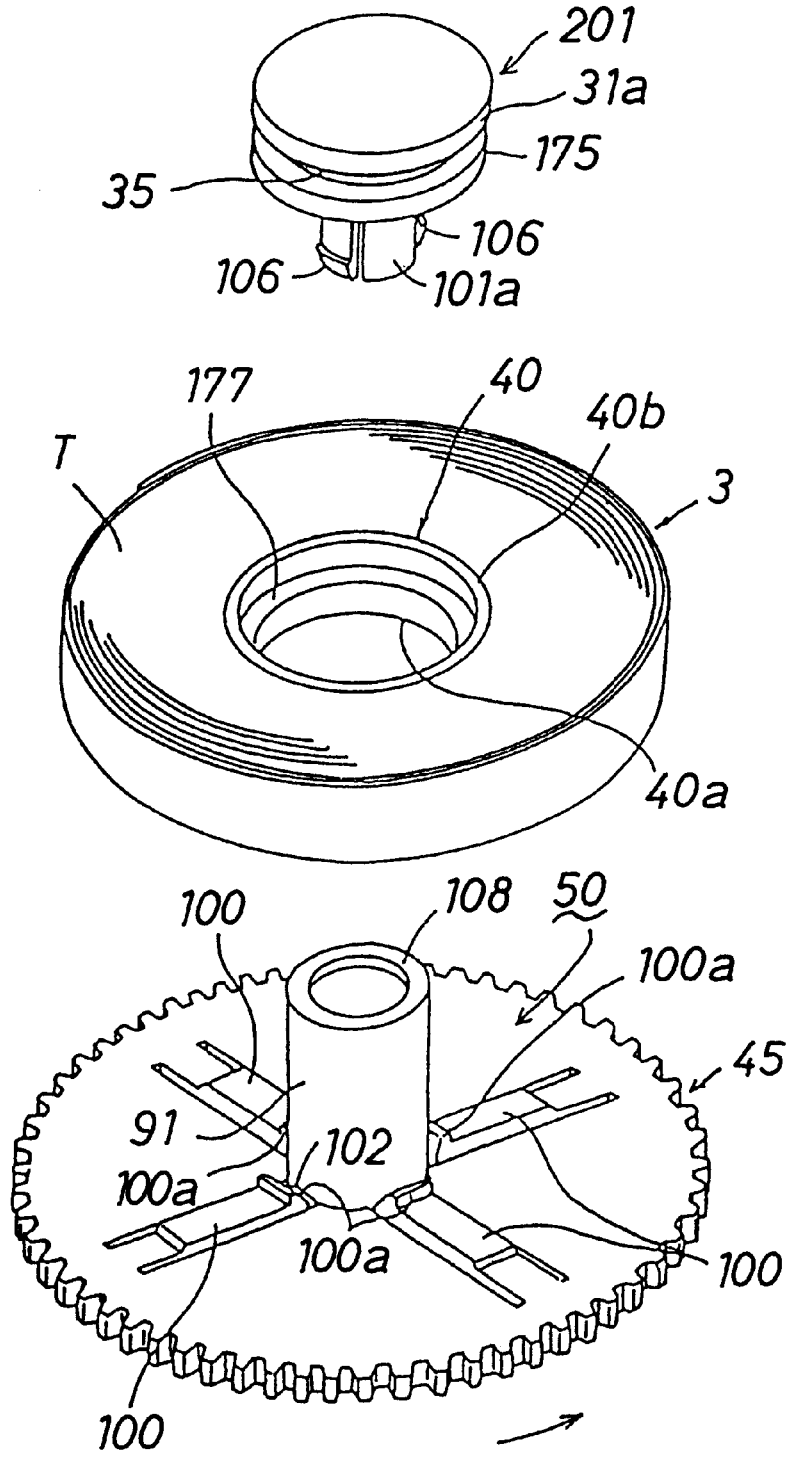
FIG. 29 is a perspective exploded view of the pay-off reel side position.

This embodiment is shown in FIG. 28 and FIG. 29, in which the structure of the clutch mechanism 50 is modified.

That is, in the constitution of embodiment 1 (FIG. 1 to FIG. 15), the tape rewinding mechanism is omitted.

Specifically, in the clutch mechanism 50, an engaging support member 201 has the shape and dimension to be contained in the case 2, and the axial engaging portion 175 disposed in this engaging support member 201 is formed, as shown in the drawing, as an engaging flange projecting horizontally in the radial direction from the outer circumference of the engaging support member 201.

In correspondence therewith, at the axial end face 40*b* of the tape core 40, an engaging recess 177 is formed, and this engaging recess 177 is formed as an annular recess to be fitted to the engaging flange 175 on its outer circumference.

The other structure and action are same as in embodiment 1.

Embodiment 11

Figure 30:
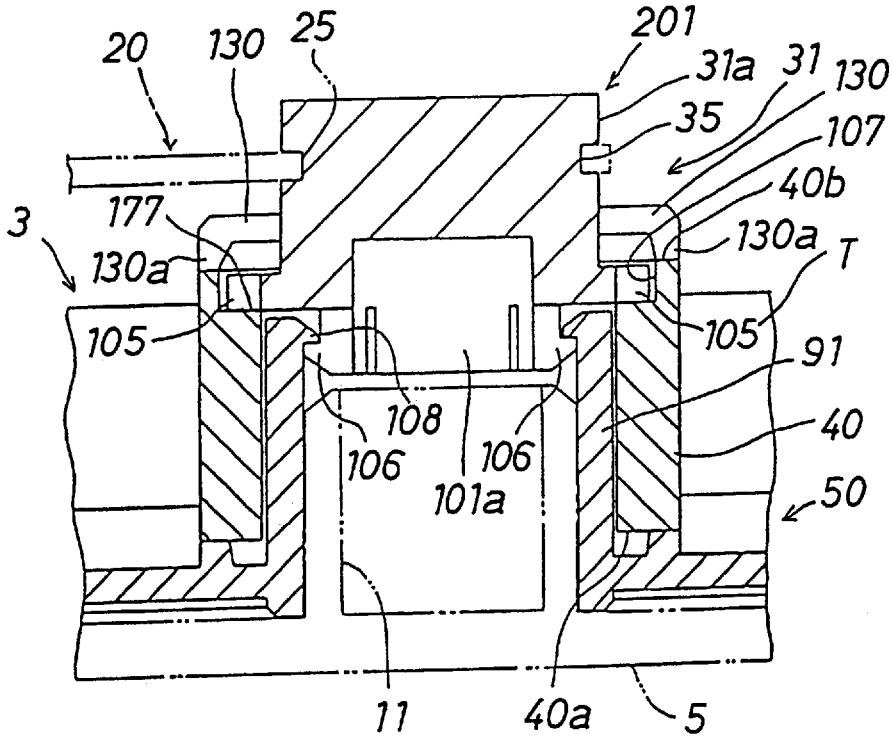
FIG. 30(*a*) is a front sectional view showing the pay-off reel side position which is a principal part of a tape cartridge of an eraser in embodiment 11 of the invention.
Figure 30:
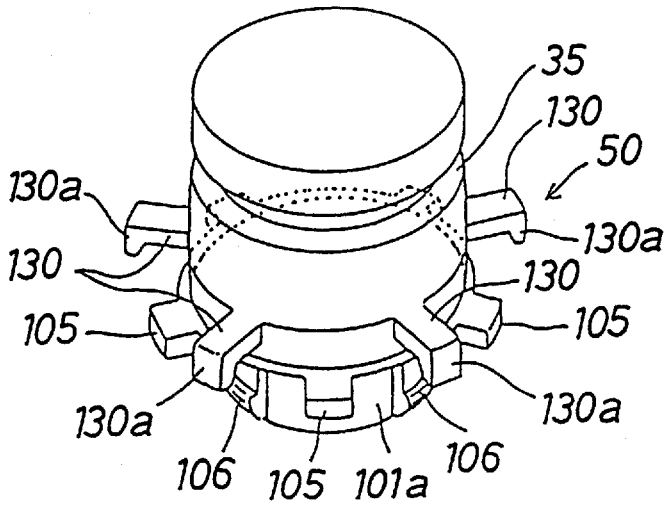

This embodiment is shown in FIG. 30, in which the structure of the clutch mechanism 50 is modified.

That is, same as in embodiment 10, in the clutch mechanism 50 omitting the tape rewinding mechanism, a frictional engaging member is integrally provided in the engaging support member 201.

Specifically, the clutch mechanism 50 of the embodiment is a combination of the structure of embodiment 10 and the structure of embodiment 8 (FIG. 26). In this case, same as in embodiment 8, in consideration of each of forming of the engaging support member 201 by injection molding, the engaging protrusions 130 are positioned at equal intervals between the axial engaging portions 105 and 105.

The other structure and action are same as in embodiment 10.

Embodiment 12

Figure 31:
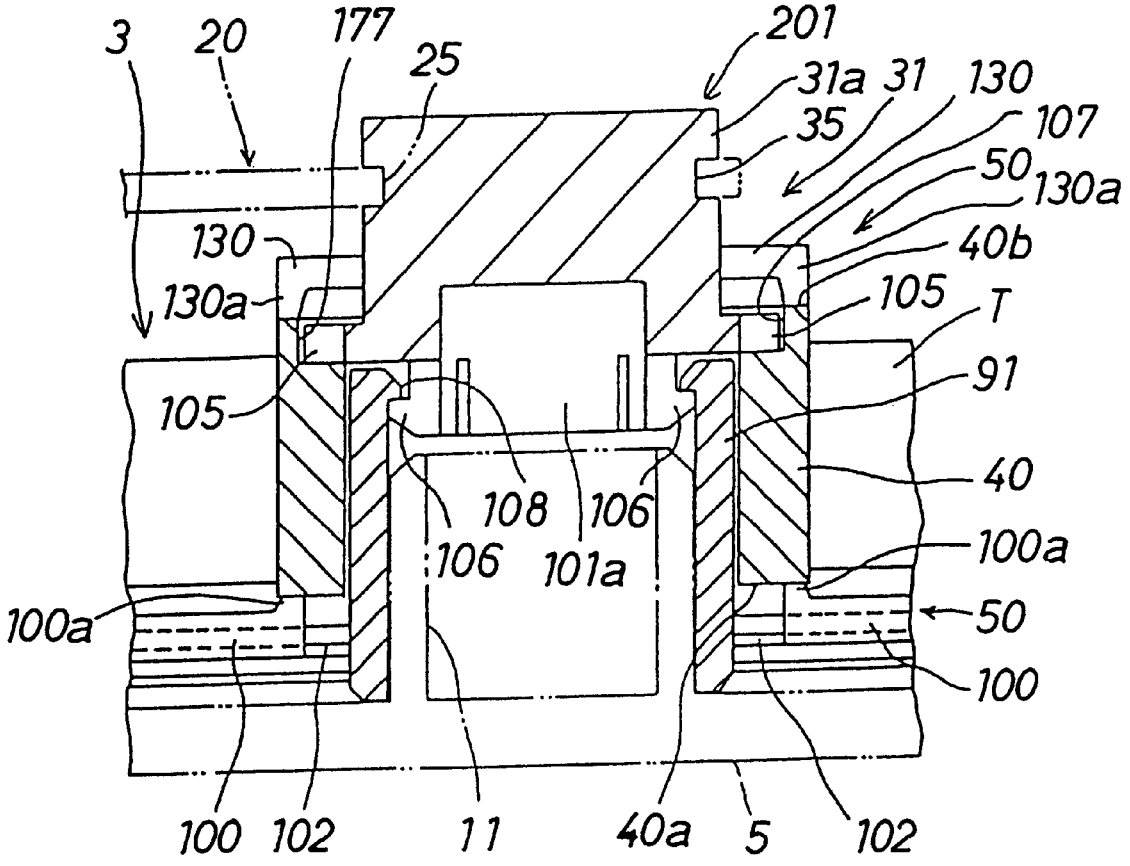
FIG. 31 is a front sectional view showing the pay-off reel side position which is a principal part of a tape cartridge of an eraser in embodiment 12 of the invention.

This embodiment is shown in FIG. 31, in which the structure of the clutch mechanism 50 is modified.

That is, the clutch mechanism 50 is a combination of the structure in embodiment 1 (FIG. 1 to FIG. 18) and the structure in embodiment 11 (FIG. 30).

Specifically, the pay-off rotary gear 45 is integrally provided with engaging protrusions 100, 100, . . . , and the engaging support member 201 is integrally provided with engaging protrusions 130, 130, . . . , and the structure of the engaging protrusions 100, 130 is same as in embodiment 1 and embodiment 11, respectively.

The other structure and action are same as in embodiment 10.

Embodiment 13

Figure 32:
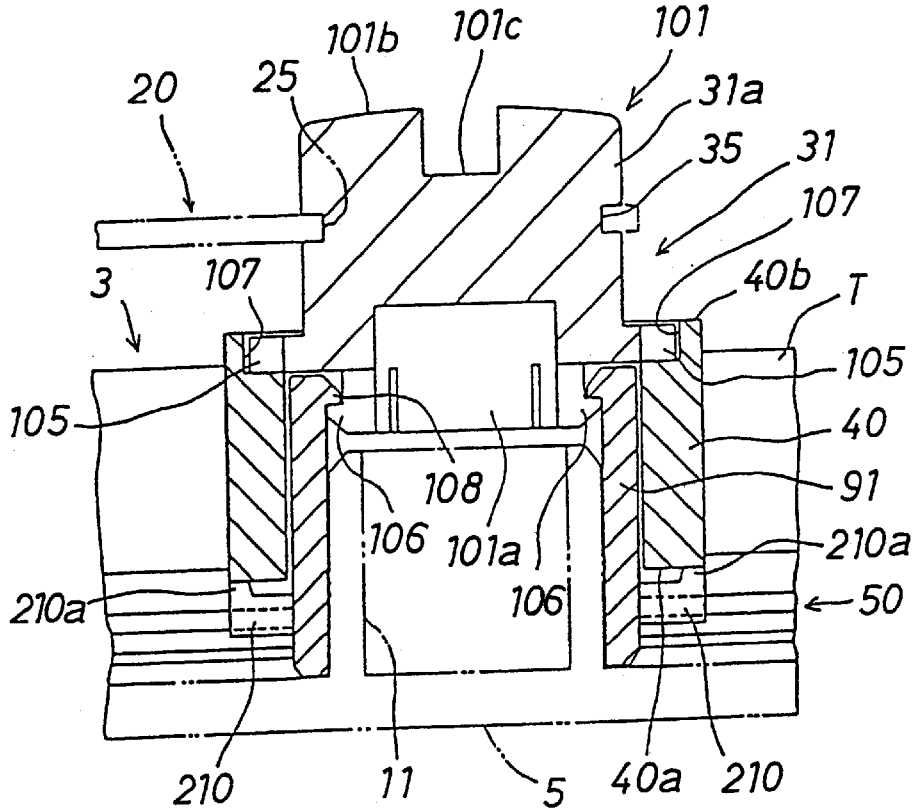
FIG. 32(*a*) is a front sectional view showing the pay-off reel side position which is a principal part of a tape cartridge of an eraser in embodiment 13 of the invention.
Figure 32:
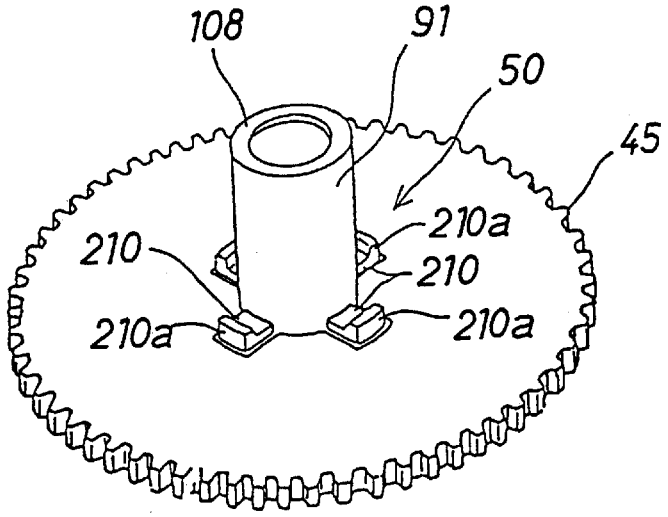

This embodiment is shown in FIG. 32, in which the structure of the clutch mechanism 50 is slightly modified.

Specifically, engaging protrusions (frictional engaging members) 210, 210, . . . integrally formed in the pay-off rotary gear 45 are extended to the outside in the radial direction from the rotary shaft 91 of the pay-off rotary gear 45, and engaging portions 210*a*, 210*a*, . . . thereof are frictionally engaged with the axial end face 40*a* of the tape core 40.

The other structure and action are same as in embodiment 1.

Embodiment 14

Figure 33:
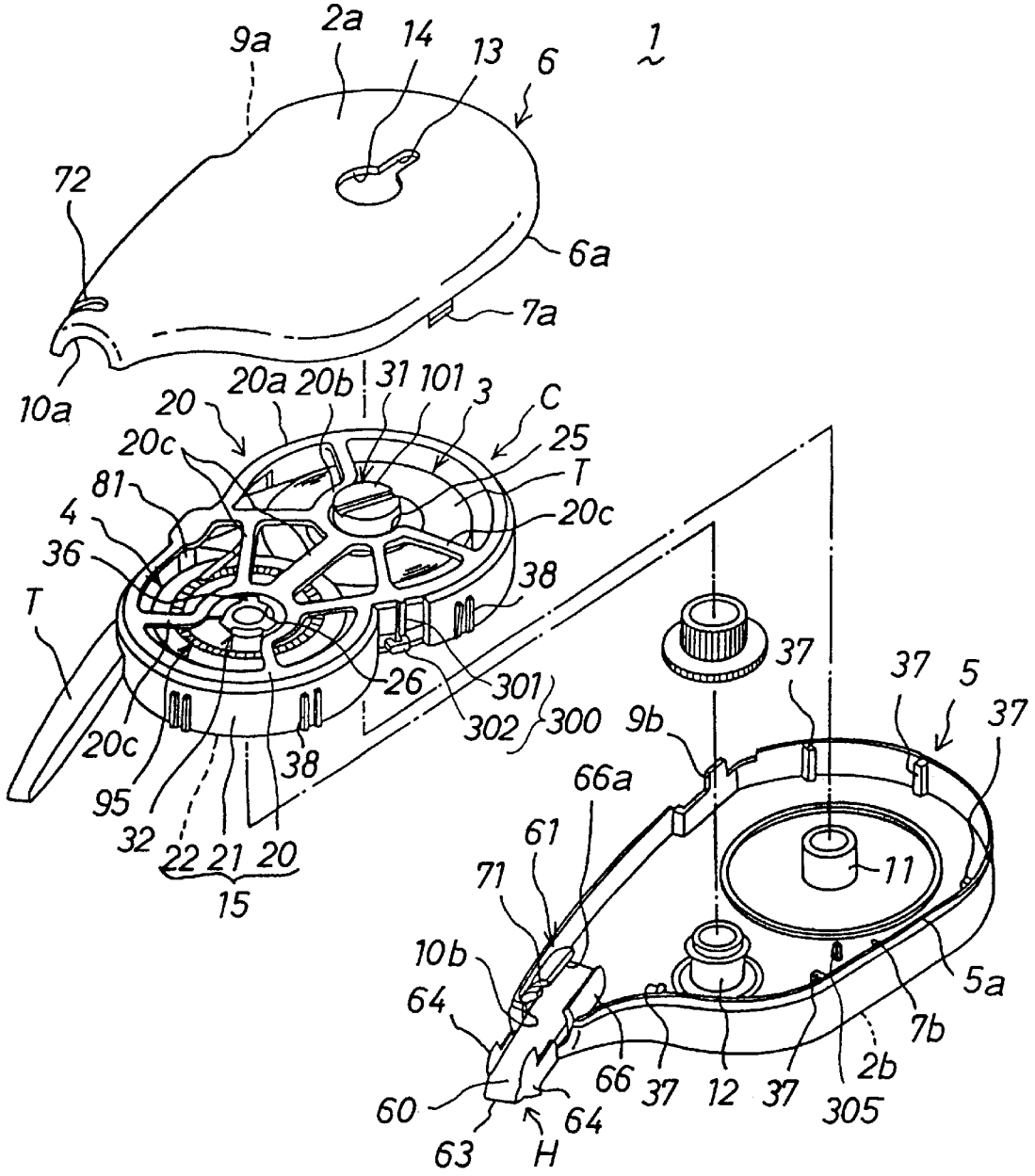
FIG. 33 is a perspective exploded view of an erase in embodiment 14 of the invention.
Figure 34:
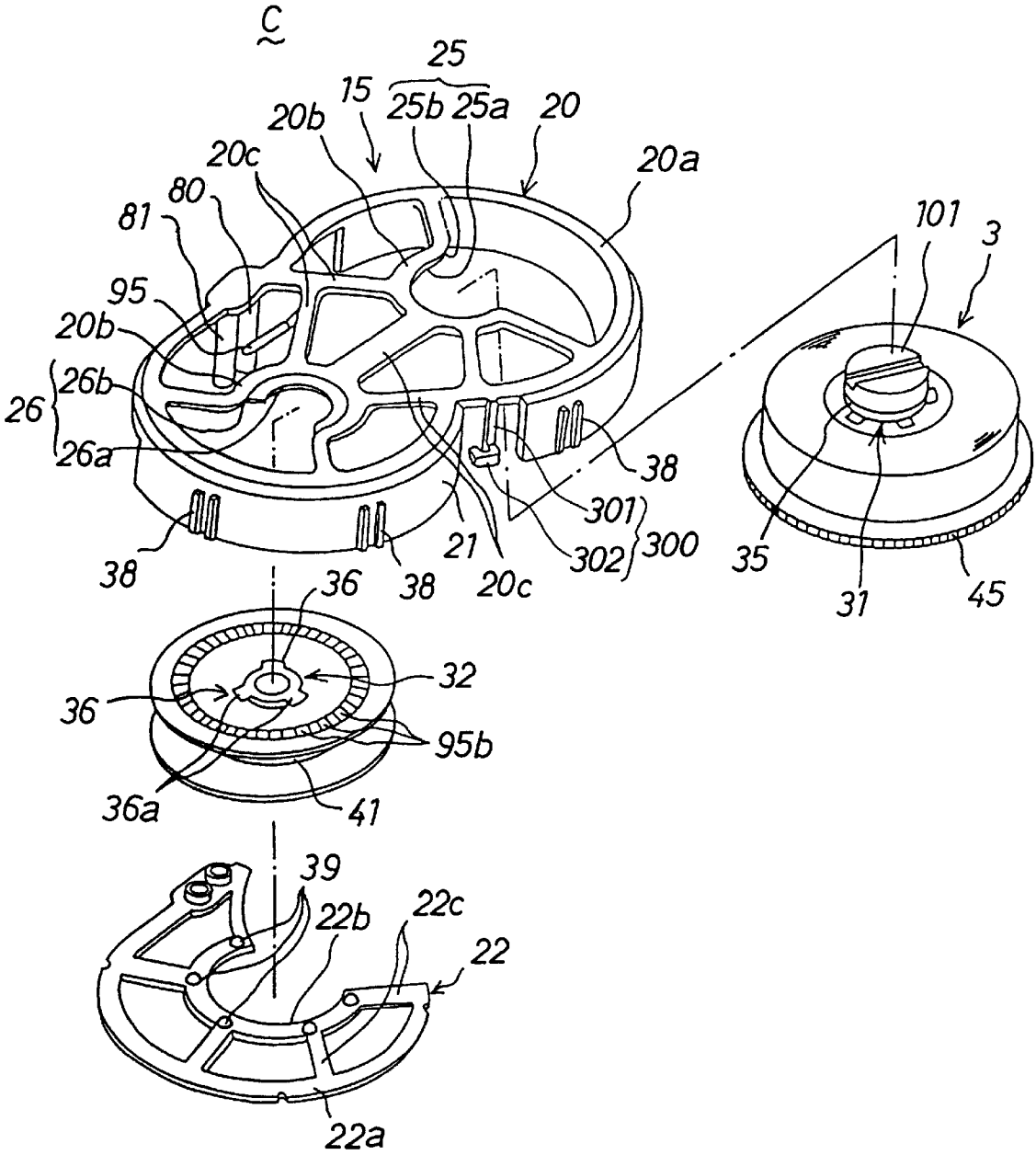
FIG. 34 is a perspective exploded view of a tape cartridge of the eraser.

This embodiment is shown in FIG. 33 and FIG. 34, in which the mounting position of the coat film transfer head H is modified.

That is, in this embodiment, the coat film transfer head H is attached to the leading end portion of the case 2. The structure of the coat film transfer head H is identical with that in embodiment 1, except for the mounting position.

The other structure and action are same as in embodiment 1.

The foregoing embodiments 1 to 14 are preferred embodiments of the invention, and the invention is not limited to them alone, but may be changed and modified in various forms within the specified range. For example, the following changes are possible.

(1) The constituent parts of the tape cartridge C, for example, the support main body 15, particularly, its support base plate 20, and the structure of the coat film transfer head H are not limited to the illustrated embodiments alone as far as the specified purpose is achieved.

(2) In the illustrated embodiments, the clutch mechanism 50 is disposed at the pay-off reel 3 side, but it may be also disposed at the take-up reel side 4 depending on the purpose, or may be disposed at both reels 3, 4. Thus, when the clutch mechanism is provided at the both reels 3, 4, in the rewinding operation by the tape rewind mechanism, application of excessive tension on the coat film transfer tape T can be effectively prevented.

(3) Instead of the correction paint layer of the coat film transfer tape T in the illustrated coat film transfer tool, by using a paint layer presenting a clear fluorescent color, the position coated with this paint layer is emphasized visually, so that it can be used as a so-called marker coat film transfer tool.

(4) As the coat film transfer tape T, by using film base material of which one side is coated with an adhesive through a peeling layer, the coat film transfer tool may be used as a gluing tool for transferring only the adhesive layer on the paper.

(5) In the illustrated embodiments, before the tape cartridge C is installed in the case 2, it is designed to stop and hold the rotation of the pay-off reel 3 and take-up reel 4 by collaboration of the reverse rotation preventive mechanism 95 and rotation stopping mechanism 300, but the rotation stopping mechanism 300 may be also provided at the take-up reel 4 side of the support main body 15 to stop the rotation of the both reels 3, 4 directly.

(6) The structure of the rotation stopping mechanism 300 and the structure of the rotation stop release part 305 of the case 2 collaborating with this rotation stopping mechanism 300 are not limited to the illustrated embodiments alone as far as the same functions are presented.

For example, in the illustrated embodiments, the rotation stopper 301 of the rotation stopping mechanism 300 is engaged with the pay-off rotary gear 45, and the pay-off rotary gear 45 functions as the engaging portion of the pay-off reel 3, and the structure is simplified as far as possible, but the engaging portion to be engaged with the rotation stopper 301 may be provided independently of the pay-off rotary gear 45.

As described in detail herein, the invention brings about the following characteristic effects, and the refill type coat film transfer tool presents a structure having a support main body of lightweight and simple structure and capable of replacing the coat film transfer tape easily, promptly and securely, and a small, simple and inexpensive structure so as to be used like a writing tool depending on the manner of holding the writing tool by the user.

(1) In the tape cartridge, the support main body ha s a support base plate for rotatably supporting the opposite side ends of rotary shafts of the pay-off reel and take-up reel supported detachably and rotatably on the rotary support shaft of the case of the coat film transfer tool, and this support plate has a flat skeletal structure having an outer contour corresponding to the inner contour of the case, and therefore, as compared with the conventional plastic container, the rate of use of the materials in the entire support main body is substantially curtailed.

(2) The support main body integrally comprises rotation stopping means for stopping and holding the rotation of the pay-off reel and/or take-up reel, and this rotating stopping means has a structure to be engaged with the reels to stop rotation of the reels in a state before the support main body is installed in the case, that is, in an ordinary state, and engaged with a rotation stop release part provided in the case and released from the reels in a state of the tape cartridge being installed in the case, and therefore an independent rotation stopping member in the prior art that is discarded after use is not required at all, and hence the number of parts is curtailed also in this aspect.

(3) Further, the support main body has at least a rotatable pay-off reel on which a coat film transfer tape is wound, and a rotatable take-up reel for collecting the coat film transfer tape after use, so that it can be replaced instantly.

That is, the support main body is designed to support rotatably the opposite side ends of rotary shafts of the both reels supported on the rotary support shaft of the case, and therefore the user has only to hold the support main body and put the tape cartridge into the case while keeping the rotary shaft of the reels in engagement with the rotary support shaft of the case from the upper side, then the replacement procedure is almost finished. In particular, in the structure in which the coat film transfer head is provided in the support main body, setting of the coat film transfer tape on the coat film transfer head is completed already in the product stage, and the replacement is easier and faster.

(4) In the coat film transfer head, its leading end pressing part is suited to lateral pulling use, or it is designed to rotate about the axial center of the head, so that the user can use with a sense of holding a writing tool.

In the latter structure, in particular, the coat film transfer head rotates about the axial center of the head in a specified range, and depending on the application or manner of holding by the user, the head position can be held in an appropriate state. It also includes a concept that the coat film transfer tool of the invention, if originally designed for use by a right-handed user in the head basic structure, can be held and used by a left-handed user naturally in an optimum head position.

(5) In the clutch mechanism, the tape core and the rotation drive unit are frictionally engaged with each other in the rotating direction by the power transmitting means utilizing the frictional force by thrust load, and in the synchronizing operation, each constituent member smoothly slides relatively, and the sense of manipulation is smooth, and no uneven running occurs.

The frictional engaging force of the power transmitting means may be set at an optimum value by properly adjusting the engaging dimensional relation in the axial direction of the rotary drive unit and the engaging support member, and setting the axial engaging force of the two, and therefore as compared with the structure of making use of frictional force by radial load, the designing and manufacturing conditions of the constituent members are not severe, and the manufacture is easy and also the assembling work is easy, so that the manufacturing cost and the device cost may be lowered.

The structure of the clutch mechanism is simple, and the number of constituent pats is small, and it is easy to manufacture and a high assembling precision is obtained at low cost, and in this respect, too, the cost of the coat film transfer tool itself can be lowered.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A tape cartridge for coat film transfer tool replaceably loaded in a case of a coat film transfer tool, said coat film transfer tool comprising a pay-off reel having the coat film transfer tape and a take-up reel for collecting the coat film transfer tape after use, both rotating in cooperation, and further a coat film transfer head for pressing the coat film transfer tape on a transfer area, wherein at least the rotatable pay-off reel having the coat film transfer tape and the rotatable take-up reel for collecting the coat film transfer tape are provided on a support body, this support body has a support base plate for rotatably supporting opposite side ends of rotary shafts of both reels supported detachably and rotatably on a rotary support shaft of the case, and said support base plate has a flat skeletal structure having an outer contour corresponding to an inner contour of the case.

2. The tape cartridge for coat film transfer tool of claim 1, wherein the skeletal structure of the support base plate is composed of an outer contour skeletal member forming the outer contour of the support base plate, a bearing skeletal member forming the bearing for rotating and supporting the rotary shaft of the reel, and a connection skeletal member for connecting the both skeletal members, which are connected in a flat skeletal structure.

3. The tape cartridge for coat film transfer tool of claim 2, wherein said connection skeletal member is formed as being extended in the radial direction from the bearing.

4. The tape cartridge for coat film transfer tool of claim 2, wherein said bearing skeletal member forms said bearing in a plane arc form opened in part, and an engaging part formed at the opposite side end of the rotary shaft of the reel is engaged and supported rotatably and slidably on the inner support part of the bearing.

5. The tape cartridge for coat film transfer tool of claim 4, wherein the both bearings for rotatably supporting the both reels are formed as bearings having mutually confronting outward opening parts.

6. The tape cartridge for coat film transfer tool of claim 1, wherein on an outer peripheral edge of the support base plate, a protective wall is integrally formed upright for surrounding and protecting both reels, and the support base plate and protective wall are combined to form a cartridge case for surrounding and holding three sides of both reels.

7. The tape cartridge for coat film transfer tool of claim 6, wherein the cartridge case composed of the support base plate and protective wall is formed in one piece made of synthetic resin.

8. The tape cartridge for coat film transfer tool of claim 6, wherein on the outer circumference of the protective wall, there is an engaging part to be engaged with a positioning engaging part provided in an inner circumference of the case of the coat film transfer tool, and when the tape cartridge is put in the case of the coat film transfer tool, both reels are rotatably supported on both sides by the rotary support shaft and support base plate of the case.

9. The tape cartridge for coat film transfer tool of claim 6, wherein on an open side edge of the protective wall, there is a protective plate for covering and protecting the opposite side end of the take-up reel rotated and supported on the support base plate, and the protective plate has a flat skeletal structure parallel to the support base plate.

10. The tape cartridge for coat film transfer tool of claim 6, wherein on an inner side of said protective plate, there is a support part for supporting slidably and rotatably the opposite side end of the take-up reel rotated and supported on the support base plate.

11. The tape cartridge for coat film transfer tool of claim 1, wherein at least one of the two reels is provided with a clutch mechanism for synchronizing a pay-off speed and take-up speed of the coat film transfer tape in both reels.

12. The tape cartridge for coat film transfer tool of claim 11, wherein said clutch mechanism specifically comprises a cylindrical tape core on which the coat film transfer tape is wound, a rotary drive unit for rotating and driving the tape core, and an engaging support member to be engaged with the rotary drive unit in the axial direction, and said tape core is supported at both sides in the axial direction by the rotary drive unit and engaging support member, and the tape core and the rotary drive unit are frictionally engaged with each other in the rotating direction by power transmitting means making use of a frictional force by thrust load.

13. The tape cartridge for coat film transfer tool of claim 12, wherein power transmitting means of said clutch mechanism comprises a plurality of frictional engaging members elastically deformable in the axial direction, provided integrally at least in one of the rotary drive unit and engaging support member, and the frictional engaging members are repulsively engaged with a specified pressing force with an axial end face of the tape core, by an axial engaging force of the rotary drive unit and engaging support member.

14. The tape cartridge for coat film transfer tool of claim 13, wherein the tape core is supported coaxially and rotatably on the rotary shaft of the rotary drive unit, the frictional engaging members of the power transmitting means are engaging protrusions formed integrally at a plurality of positions in the circumferential direction of at least one of the rotary drive unit and engaging support member, and the engaging protrusions are elastically deformable in the axial direction, and are repulsively engaged with a specified pressing force with a flat axial end face opposite to the tape core, by the axial engaging force of the rotary drive unit and engaging support member.

15. The tape cartridge for coat film transfer tool of claim 14, wherein said engaging support member includes an axial engaging part to be engaged with the axial end face of the tape core, and a detent pawl to be engaged with the rotary shaft of the rotary drive unit, and when the detent pawl of the engaging support member is engaged with the support part of the rotary drive unit, the engaging protrusions are repulsively engaged with a specified pressing force with the flat axial end face opposite to the tape core, by the engaging force of the axial engaging part to the tape core.

16. The tape cartridge for coat film transfer tool of claim 14, wherein said engaging support member includes a rotary engaging part to be engaged with the axial end face of the tape core in the rotating direction, and a rotary operation part for rewind rotary operation.

17. The tape cartridge for coat film transfer tool of claim 1, wherein said support body has a coat film transfer head for pressing the coat film transfer tape onto the transfer area, and the coat film transfer head has its base end support part supported rotatably about a head axial center of the head holder of the support body.

18. The tape cartridge for coat film transfer tool of claim 17, wherein said coat film transfer head consists of a head main body for pressing and transferring the coat film transfer tape, a head holder for supporting the head main body rotatably about its axial center, and a rotary operation part for positioning and operating the rotating direction position of the head main body, and this rotary operation part serves also as the head position display unit showing the tape pressing and transferring position of the head main body.

19. The tape cartridge for coat film transfer tool of claim 18, wherein said rotary operation part includes an operation lever provided in relation to the tape pressing and transferring position of the head main body, and this operation lever projects oppositely to the outside of the case, through an operation guide part in a slit form penetrating in the case of the coat film transfer tool.

20. The tape cartridge for coat film transfer tool of claim 19, wherein said operation guide part in a slit form defines the operating range of the operation lever in the rotating direction, and controls the tape pressing and transferring position of the head main body.

21. The tape cartridge for coat film transfer tool of claim 1, wherein said support body has a coat film transfer head for pressing the coat film transfer tape onto the transfer area, and the leading end pressing part of this coat film transfer head is formed as a linear edge extending nearly vertically to a rotary axial line of the both reels supported on the support base plate.

22. The tape cartridge for coat film transfer tool of claim 21, wherein said coat film transfer head has its base end integrally provided in the support body, and is formed in an elastically deformable plate.

23. A tape cartridge for coat film transfer tool replaceably loaded in a case of a coat film transfer tool, said coat film transfer tool comprising a pay-off reel having the coat film transfer tool and a take-up reel for collecting the coat film transfer tape after use, both rotating in cooperation, and further a coat film transfer head for pressing the coat film transfer tape on a transfer area, wherein the rotatable pay-off reel having the coat film transfer tape and the rotatable take-up reel for collecting the coat film transfer tape after use are provided on a support body, said support body integrally comprises rotation stopping means for stopping and holding the rotation of the reels, and said rotation stopping means has a structure to be engaged with the reels to stop rotation of the reels in a state before the support body is installed in the case, and engaged with a rotation stop release part provided in the case and released from the reels in a state of the tape cartridge being installed in the case.

24. The tape cartridge for coat film transfer tool of claim 23, wherein said rotation stopping means is provided at the pay-off reel side of the support body, and reverse rotation preventive means for preventing reverse rotation of the reel is provided at the take-up reel side of the support body, and before the support body is installed in the case, rotation of the both reels is stopped and held by the collaborating action of the rotation stopping means and reverse rotation preventive means.

25. The tape cartridge for coat film transfer tool of claim 24, wherein said reverse rotation preventive means includes an elastically deformable detent pawl provided in the support body, and a plurality of reverse rotation preventive pawls provided on an opposite side of the take-up reel concentrically and annularly on a rotary axial center of the take-up reel.

26. The tape cartridge for coat film transfer tool of claim 24, wherein said rotation stopping means integrally includes an elastically deformable rotation stopper repulsively engaged with the engaging part of the pay-off reel, and a release engaging part to be engaged with the engaging part of the rotation stop release part provided in the case, and when the release engaging part is not engaged with the engaging part of the rotation stop release part, said rotation stopper is repulsively engaged with the engaging part of the pay-off reel from the outside in the radial direction, and when the release engaging part is engaged with the engaging part of the rotation stop release part, said rotation stopper is elastically deformed outward in the radial direction of the pay-off reel, and is cleared from the engaging part of the pay-off reel.

27. The tape cartridge for coat film transfer tool of claim 23, wherein said support body has a support base plate detachably and rotatably supported on the rotary support shaft of the case for rotatably supporting the opposite side ends of the rotary shafts of the both reels, and this support base plate has a flat skeletal structure having an outer contour corresponding to the inner contour of the case.

28. A refillable coat film transfer tool, comprising:

a case held and operated by one hand, and a replaceable tape cartridge for coat film transfer tool disposed in the case, wherein said tape cartridge comprises, in a support main body, a rotatable pay-off reel having the coat film transfer tape, a rotatable take-up reel for collecting the coat film transfer tape after use, and a coat film transfer head for pressing the coat film transfer tape on a transfer area, said support main body has a support base plate for rotatably supporting the opposite side ends of rotary shafts of both reels, and this support base plate has a flat skeletal structure having an outer contour corresponding to an inner contour of the case, and said case incorporates a rotary support shaft for detachably and rotatably supporting the pay-off reel and take-up reel of the tape cartridge, and when the tape cartridge is installed in the case, both reels are rotatably supported on both sides, by both rotary support shafts and the support base plate of the support main body of the tape cartridge, and the coat film transfer head is positioned and held rotatably about a head axial center, in a head holding part provided at a leading end of the case.

29. The coat film transfer tool of claim 28, wherein said case incorporates a pair of rotary support shafts for detachably and rotatably supporting the pay-off reel and take-up reel of the tape cartridge, an interlock mechanism for interlocking the pay-off reel and take-up reel is composed of an interlock gear provided at one of the two reels and an interlock gear provided at other side, being meshed with each other, and one interlock gear is rotatably supported on the rotary support shaft for supporting one of the reels, and other interlock gear is integrally formed in the rotary drive unit of the clutch mechanism provided in the other one of the two reels.

30. The coat film transfer tool of claim 28, further comprising:

a tape rewind mechanism for eliminating slack of the coat film transfer tape between the two reels, wherein this tape rewind mechanism has an engaging support member of the clutch mechanism disposed opposite to an exterior of the case, and a rotary operation part for rewind rotary operation is formed at the outer end of this engaging support member.

31. The coat film transfer tool of claim 30, wherein said case has a split structure to be opened and closed, and the tightening cap for tightening and fixing the closed state of the case functions also as the operation member of the rotary operation part for rewinding rotary operation.

32. A refillable coat film transfer tool, comprising:

a case held and operated by one hand, and a replaceable tape cartridge for coat film transfer tool disposed in the case, wherein said tape cartridge comprises, in a support main body, a rotatable pay-off reel having the coat film transfer tape, a rotatable take-up reel for collecting the coat film transfer tape after use, and a coat film transfer head for pressing the coat film transfer tape on a transfer area, said support main body has a support base plate for rotatably supporting the one side end of rotary shafts of both reels, and this support base plate has a flat skeletal structure having an outer contour corresponding to an inner contour of the case, said case incorporates a rotary support shaft for detachably and rotatably supporting the pay-off reel and take-up reel of the tape cartridge, and when the tape cartridge is installed in the case, both reels are rotatably supported on both sides, by the both rotary support shafts and the support base plate of the support main body of the tape cartridge, and the coat film transfer head is positioned and held in a head holding part provided at a leading end of the case, and the leading end pressing part of the coat film transfer head is formed as a linear edge extending almost vertically to a rotary axial line of both reels.

33. The coat film transfer tool of claim 32, wherein said case incorporates a pair of rotary support shafts for detachably and rotatably supporting the pay-off reel and take-up reel of the tape cartridge, an interlock mechanism for interlocking the pay-off reel and take-up reel is composed of an interlock gear provided at one of the two reels and an interlock gear provided at other side, being meshed with each other, and one interlock gear is rotatably supported on the rotary support shaft for supporting one of the reels, and other interlock gear is integrally formed in the rotary drive unit of the clutch mechanism provided in the other one of the two reels.

34. The coat film transfer tool of claim 32, further comprising:

a tape rewind mechanism for eliminating slack of the coat film transfer tape between the two reels, wherein this tape rewind mechanism has an engaging support member of the clutch mechanism disposed opposite to the outside of the case, and a rotary operation part for rewind rotary operation is formed at the outer end of this engaging support member.

35. The coat film transfer tool of claim 34, wherein said case has a split structure to be opened and closed, and a tightening cap for tightening and fixing the closed state of the case functions also as the operation member of the rotary operation part for rewinding rotary operation.

36. A refillable coat film transfer tool, comprising:

a case held and operated by one hand, and a replaceable tape cartridge for coat film transfer tool disposed in the case, wherein said tape cartridge comprises, in its support main body, a rotatable pay-off reel having the coat film transfer tape, and a rotatable take-up reel for collecting the coat film transfer tape after use, said support main body has a support base plate for rotatably supporting the one side end of rotary shafts of both reels, and this support base plate has a flat skeletal structure having an outer contour corresponding to the inner contour of the case, said case incorporates a rotary support shaft for detachably and rotatably supporting the pay-off reel and take-up reel of the tape cartridge, and when the tape cartridge is installed in the case, both reels are rotatably supported on both sides, by both rotary support shafts and the support base plate of the support main body of the tape cartridge, and the coat film transfer head is positioned and held in a head holding part provided at a leading end of the case, and the coat film transfer head for pressing the coat film transfer tape on a transfer area is rotatably held about a head axial center, at the leading end of the case.

37. The coat film transfer tool of claim 36, wherein the coat film transfer head comprises a head main body for pressing and transferring the coat film transfer tape, a head holder for rotatably supporting the head main body about its axial center, and a rotary operation part for positioning and operating the rotating direction position of the head main body, and this rotary operation part functions also as the head position display unit for showing the tape pressing and transferring position of the head main body.

38. The coat film transfer tool of claim 37, wherein said rotary operation part includes an operation lever provided in relation to the tape pressing and transferring position of the head main body, and this operation lever projects oppositely to an exterior of the case, through an operation guide part in a slit form penetrating in the case of the coat film transfer tool.

39. The coat film transfer tool of claim 38, wherein said operation guide part in a slit form defines the operating range of the operation lever in the rotating direction, and controls the tape pressing and transferring position of the head main body.

40. The coat film transfer tool of claim 36, wherein said case incorporates a pair of rotary support shafts for detachably and rotatably supporting the pay-off reel and take-up reel of the tape cartridge, an interlock mechanism for interlocking the pay-off reel and take-up reel is composed of an interlock gear provided at one of the two reels and an interlock gear provided at other side, being meshed with each other, and one interlock gear is rotatably supported on the rotary support shaft for supporting one of the reels, and other interlock gear is integrally formed in the rotary drive unit of the clutch mechanism provided in the other one of the two reels.

41. The coat film transfer tool of claim 36, further comprising:

a tape rewind mechanism for eliminating slack of the coat film transfer tape between the two reels, wherein this tape rewind mechanism has an engaging support member of the clutch mechanism disposed opposite to an exterior of the case, and a rotary operation part for rewind rotary operation is formed at an outer end of this engaging support member.

42. The coat film transfer tool of claim 41, wherein said case has a split structure to be opened and closed, and a tightening cap for tightening and fixing the closed state of the case functions also as the operation member of the rotary operation part for rewinding rotary operation.

* * * * *